US011312166B2

(12) United States Patent
Ueda

(10) Patent No.: US 11,312,166 B2
(45) Date of Patent: Apr. 26, 2022

(54) PRINTED MATTER AND METHOD OF PRODUCING PRINTED MATTER

(71) Applicant: TOPPAN PRINTING CO., LTD., Tokyo (JP)

(72) Inventor: Reiko Ueda, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 111 days.

(21) Appl. No.: 16/263,666

(22) Filed: Jan. 31, 2019

(65) Prior Publication Data

US 2019/0160842 A1 May 30, 2019

Related U.S. Application Data

(63) Continuation of application No. PCT/JP2017/027512, filed on Jul. 28, 2017.

(30) Foreign Application Priority Data

Aug. 1, 2016 (JP) ..... JP2016-151370
Feb. 15, 2017 (JP) ..... JP2017-026250

(51) Int. Cl.
*B41M 1/10* (2006.01)
*B41M 3/06* (2006.01)
(Continued)

(52) U.S. Cl.
CPC ..... *B41M 1/10* (2013.01); *B41F 9/01* (2013.01); *B41M 3/06* (2013.01); *B41M 3/14* (2013.01);
(Continued)

(58) Field of Classification Search
CPC ..... B42D 25/337
See application file for complete search history.

(56) References Cited

U.S. PATENT DOCUMENTS 4,124,947 A * 11/1978 Kuhl ..... B41M 3/14 101/150
6,856,462 B1 2/2005 Scarbrough et al.
(Continued)

FOREIGN PATENT DOCUMENTS

DE 10 2004 046 695 A1 3/2006
DE 102004046695 A1 * 3/2006 ..... B42D 25/00
(Continued)

OTHER PUBLICATIONS

International Searching Authority, "International Search Report," issued in connection with International Patent Application No. PCT/JP2017/027512, dated Sep. 5, 2017.
(Continued)

*Primary Examiner* — Jennifer Bahls
(74) *Attorney, Agent, or Firm* — Foley & Lardner LLP

(57) ABSTRACT

Printed matter having a continuous color pattern, such as a high-definition fine printed design pattern. The printed matter has a printed portion on a surface of a printing substrate. The printed portion is formed of an ink and visually recognized as a continuous color pattern. Further, the printed portion is constituted of a combination of a plurality of lines each being formed of an ink and having a line width of 100 μm or less. Of the plurality of lines, two adjacent lines have a spacing there between which is 50 times or less the line width of the line that is the narrower one of the two lines defining the spacing.

17 Claims, 18 Drawing Sheets

A-SURFACE PRINTED PORTION

(51) Int. Cl.

| | |
|---|---|
| ***B41M 3/14*** | (2006.01) |
| ***B42D 25/328*** | (2014.01) |
| ***B42D 25/29*** | (2014.01) |
| ***B41N 1/06*** | (2006.01) |
| ***B41F 9/01*** | (2006.01) |

(52) U.S. Cl.
CPC ..... *B41N 1/06* (2013.01); *B42D 25/29* (2014.10); *B42D 25/328* (2014.10)

(56) References Cited

U.S. PATENT DOCUMENTS

| | | | | |
|---|---|---|---|---|
| 9,107,336 | B2 * | 8/2015 | Droz | G06K 19/07718 |
| 2009/0016776 | A1 * | 1/2009 | Priebe | G03G 15/221 399/231 |
| 2011/0096368 | A1 * | 4/2011 | Maher | B42D 25/333 358/3.28 |
| 2012/0193905 | A1 | 8/2012 | Schilling et al. | |
| 2014/0312606 | A1 * | 10/2014 | Lister | G03F 7/20 283/85 |
| 2014/0352560 | A1 | 12/2014 | Mayo et al. | |
| 2015/0061280 | A1 * | 3/2015 | Power | B42D 25/351 283/85 |
| 2015/0343829 | A1 * | 12/2015 | Hatton | B41M 3/148 428/30 |
| 2018/0264869 | A1 | 9/2018 | Schilling et al. | |

FOREIGN PATENT DOCUMENTS

| | | | | |
|---|---|---|---|---|
| DE | 102008012421 | B3 * | 6/2009 | B42D 25/45 |
| EP | 0 721 849 | A1 | 7/1996 | |
| EP | 3023258 | A1 * | 5/2016 | B41M 3/144 |
| JP | H11-188866 | A | 7/1999 | |
| JP | 2005-205897 | A | 8/2005 | |
| JP | 2005205897 | A * | 8/2005 | |
| JP | 2005-246746 | A | 9/2005 | |
| JP | 2011-210148 | A | 10/2011 | |
| JP | 2014-046667 | A | 3/2014 | |
| JP | 2014-137417 | A | 7/2014 | |
| JP | 2014137417 | A * | 7/2014 | |
| JP | 2014-234516 | A | 12/2014 | |
| JP | 2016-104536 | A | 6/2016 | |
| WO | WO-2011/029602 | A2 | 3/2011 | |

OTHER PUBLICATIONS

International Searching Authority, "Written Opinion," issued in connection with International Patent Application No. PCT/JP2017/027512, dated Sep. 5, 2017.
Extended European Search Report dated Feb. 11, 2020 for corresponding Application No. 17836880.9.
Office Action dated Feb. 24, 2021 for corresponding Japanese Patent Application No. 2018-531870.
Office Action on JP 2018-531870 dated Jun. 29, 2021 (12 pages).

* cited by examiner

PRINTED MATTER AND METHOD OF PRODUCING PRINTED MATTER

CROSS-REFERENCE TO RELATED PATENT APPLICATIONS

This application is a Bypass Continuation of International Patent Application No. PCT/JP2017/027512, filed on Jul. 28, 2017 which is based upon and claims the benefit of priority of Japanese Patent Application Nos. 2016-151370, filed on Aug. 1, 2016, and 2017-026250, filed on Feb. 15, 2017, the entire contents of all of which are hereby incorporated by reference in their entireties.

TECHNICAL FIELD

The present invention relates to printed matter having a certain structure and a method of producing the printed matter.

BACKGROUND ART

As a method of printing a fine print structure, there is for example, gravure offset printing. Gravure offset printing is carried out by transferring an ink to a blanket from a printing plate having concavities filled with an ink, and then transferring the ink on the blanket to a printing substrate. For example, PTL 1 discloses a method of producing an electrically conductive member for a touch panel having a wiring structure. In this method, gravure offset printing is used as a method of printing a patterned wiring structure onto a frame portion.

CITATION LIST

Patent Literature

PTL 1: JP 2011-210148 A

SUMMARY OF THE INVENTION

Technical Problem

Printed matter based on conventional art expresses a continuous color pattern with a group of fine dots (halftone dots) and expresses grayscale with the size of each halftone dot. For example, when obtaining colored printed matter by screen printing, gravure printing, or offset printing, a color print pattern is expressed based on the difference in area ratio (ink area) of the halftone dots constituted the four colors cyan, magenta, yellow, and black. Screen ruling LPI (line per inch) is used as a reference for expressing resolution level of the color printing.

This LPI represents the number of lines per inch, and printed matter in general is expressed with 175 to 200 lines. Larger LPI produces higher definition. For example, FM screening of about 1200 LPI is currently known to present the highest definition. However, printed matter of more than 2500 LPI can be realized only by printing methods having a large number of steps, such as photolithography. Therefore, it has been difficult to mass-produce such printed matter.

Moreover, it is difficult to visually recognize printed lines from printed matter of 350 or more LPI. For this reason, while printed matter of high-definition prints can be obtained, there has been little or no demand for using such high-definition printed matter.

The present invention has been made focusing on the issue set forth above and has an object to obtain a highly defined fine print of a continuous color pattern, such as a design pattern, with a print structure different from those which are based on conventional art.

Attempted Solution to Problem

To improve or even solve the issue, the printed matter according to an aspect of the present invention is wherein the printed matter has a printed portion formed of an ink on a surface of a printing substrate and visually recognized as a continuous color pattern; the printed portion is constituted of a combination of a plurality of lines each formed of an ink and having a line width of 100 μm or less; and two adjacent lines of the plurality of lines have a spacing there between that is 50 times or less the line width of a narrower one of the two adjacent lines defining the spacing.

Advantageous Effects of the Invention

According to an aspect of the invention, high-definition and fine printed matter can be obtained by combining fine lines and producing printing, such as a design pattern, that can be more visually recognized as a series of colors.

DESCRIPTION OF REPRESENTATIVE EMBODIMENTS

Detailed Description

Figure 1:
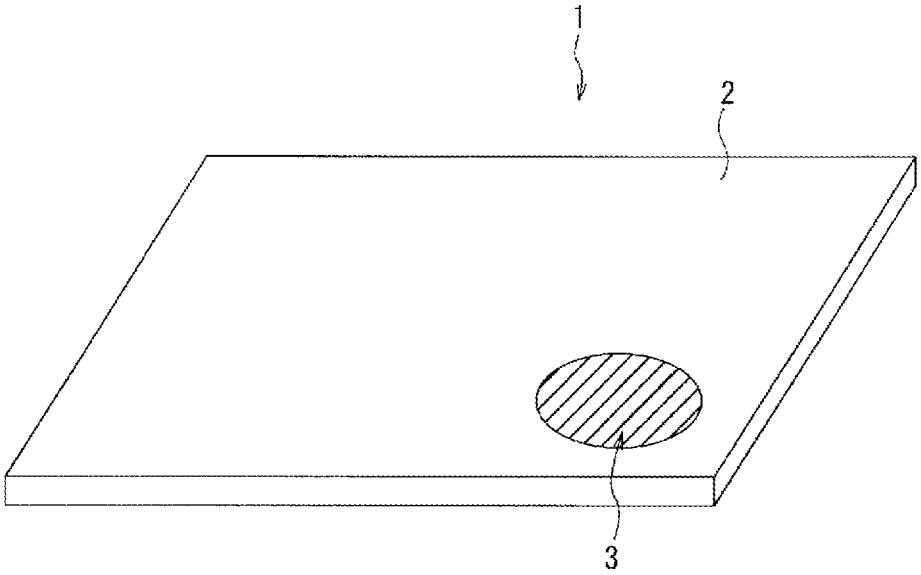
FIG. 1 is a conceptual diagram illustrating a structure of printed matter, according to a first embodiment.

With reference to the drawings, first and second embodiments of the present invention will be described.

However, the drawings herein are schematic. In the drawings, the relationship between thickness and horizontal dimension, the ratio of thickness of each layer, and the like are not to scale. The embodiments described below are merely examples of the configurations for embodying the technical idea of the present invention, and the technical idea of the present invention should not limit the materials, shapes, structures, and the like of the components to those described below. The technical idea of the present invention can be modified in various ways within the technical scope defined by the claims.

First Embodiment

As shown in FIG. 1, the printed matter 1 according to the present embodiment has a printed portion 3 on part of a surface of a printing substrate 2. The printed portion 3 is constituted of printing, such as a design pattern, formed of an ink and visually recognized as a continuous color pattern. The printing constituting the printed portion 3 does not always need to be configured so that a clear pattern, such as design pattern, can be visually recognized. The printed portion 3 of the present embodiment may be arranged at two or more positions on the printing substrate 2.

In the printed matter 1 according to the present embodiment, the printing substrate 2 and the printed portion 3 have a total thickness, for example, in the range of 5.0 μm or more and 2000.0 μm or less. The printing substrate 2 may have printed portions other than the printed portion 3 of the present embodiment. The printed portion 3 of the present embodiment may be arranged as part of a printed portion, other than the printed portion 3 of the present embodiment. The printed portion other than the printed portion 3 of the present embodiment, for example, may be a design pattern or other printing that is a group of halftone dots as in the conventional art.

Figure 2:
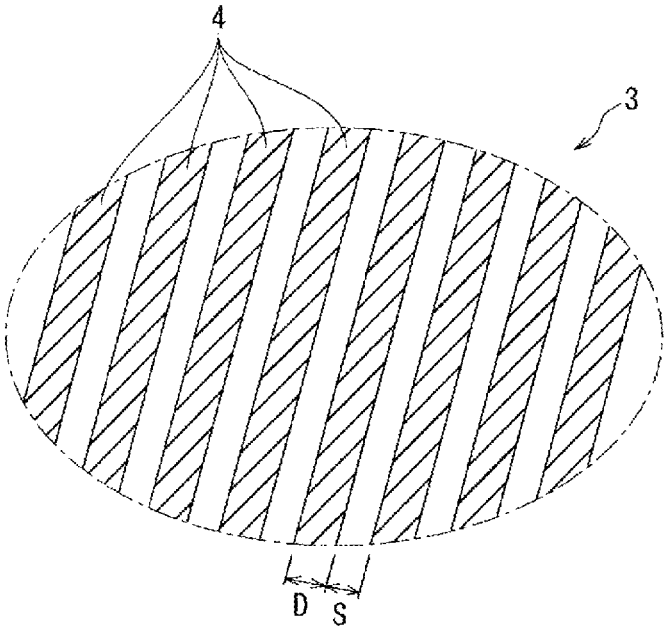
FIG. 2 is a conceptual diagram illustrating a structure of a printed portion, according to the first embodiment.

As shown in FIG. 2, in the present embodiment, the printed portion 3 formed of a design pattern or other printing is configured by, for example, combining a plurality of lines 4. The lines 4 of the present embodiment each have a line width D that cannot be visually recognized. The line width D is 100 μm or less, for example. In this case, fine color printing can be produced by constituting the printed portion 3 with a combination of colored lines 4 of at least two colors selected from, for example, the four colors of cyan, magenta, yellow, and black. The printed portion 3 may be constituted of colored lines 4 of one color. When the printed portion 3 is constituted of colored lines 4 of one color, it is preferable that the line width D and a spacing S, described later, are adjusted to achieve color having gradation. The line width D in the present embodiment refers to a line width in the direction orthogonal to the direction in which the lines 4 extend.

The arrangement of the plurality of lines 4 producing the printed portion 3 is set such that the spacing S between two adjacent lines 4 is 50 times or less the line width D of the line 4 that is the narrower one of the two lines 4 defining the spacing S. A color pattern can be visually recognized as continuous by setting the size of the spacing S to 50 times or less the line width D. If the size of the spacing S exceeds 50 times the line width D, the non-printed portion (spacing S) between the lines may be visually recognized. The lines 4 may intersect with each other, in which case the interval (spacing S) at each intersection is 0 as a matter of course. The spacing S in the present embodiment corresponds to a non-printed portion between two adjacent lines 4 and thus refers to a width in the direction orthogonal to the direction in which the non-printed portion extends.

When the plurality of lines 4 are unidirectionally arranged to constitute the printed portion 3, color gradation of the printing configuring the printed portion 3 (color gradation of the printed portion 3) is adjusted by changing the line width D of the lines 4 arranged in a unit area.

When printed matter is produced with halftone dots as in the conventional art, color gradation is expressed by changing the size of the halftone dots. Specifically, color gradation is expressed by changing the occupancy of the ink (ink area) per unit area.

In contrast, in the present embodiment, even if the ink area remains unchanged, color gradation can be adjusted by changing the line width D. For example, when lines 4 each having a width of 100 μm are arranged at intervals of 100 μm, instead of arranging lines 4 each having a width of 10 μm at intervals of 10 μm, color density (color-difference measurement value) when the lines are visually observed is higher, although the ink area remains unchanged (the area ratio is 50% in this example). Thus, in the present embodiment, color gradation can be adjusted without changing the ink area. Thus, in the present embodiment, the degree of freedom of adjusting color gradation increases, and higher-definition printing can be obtained even in micropattern printing.

The printed portion 3 is constituted by arranging a plurality of lines 4 in a specific line pattern. Examples of the specific line pattern include a pattern of unidirectionally arranging the plurality of lines 4, a pattern of concentrically arranging the plurality of lines 4, a pattern of arranging the plurality of lines 4 in a lattice shape, and a pattern radially arranging the plurality of lines 4. As a matter of course, the line pattern is not limited to the patterns mentioned above. The present embodiment can be applied to any line pattern, such as a random arrangement pattern, as long as the line pattern satisfies the requirements that the lines 4 are a combination of lines each having a line width D of 100 μm or less, and the spacing S between two adjacent lines 4 is 50 times or less the line width D of the line 4 that is the narrower one of the two lines 4 defining the spacing S.

The lines 4 do not need to extend linearly, but may extend in a curved manner, such as meandering. Although ink blur or the like may occur during printing, the lines 4 may have a length that is 1.5 times or more of the line width D. Hereafter, the lines 4 that are colored may also be referred to as colored lines 4.

The following description deals with examples of the printed portion 3 constituted of a combination of a plurality of colored lines 4.

Figure 3A:
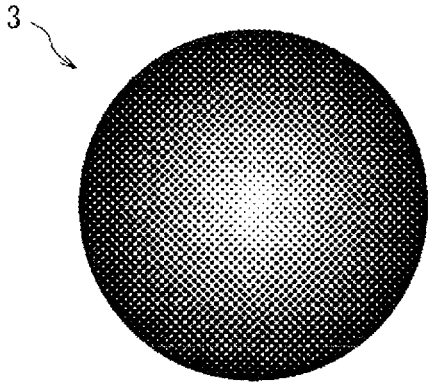
FIGS. 3A and 3B are sets of schematic diagrams illustrating an example of a line pattern, according to the first embodiment, with FIG. 3A illustrating the appearance as visually recognized from the front, and with FIG. 3B illustrating the line pattern.
Figure 3B:
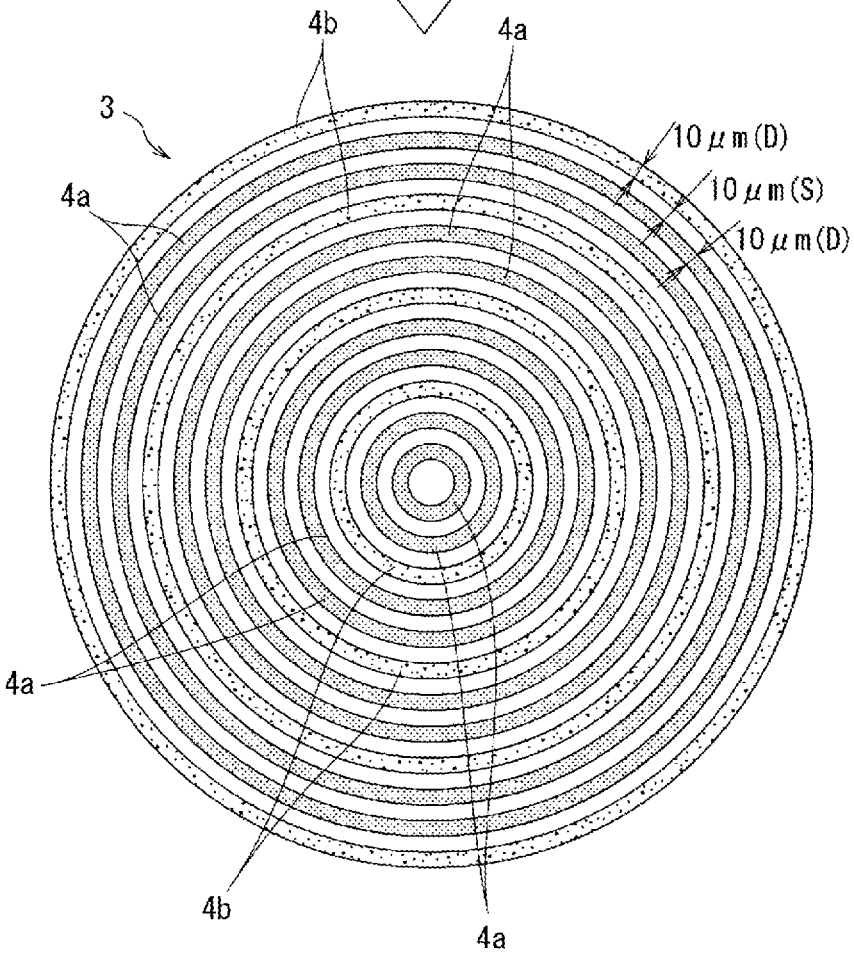

FIGS. 3A and 3B are sets of schematic diagrams illustrating a concentric line pattern. FIG. 3A is a schematic diagram illustrating a printed portion 3 as visually recognized from the front, and FIG. 3B is an enlarged schematic diagram thereof. As shown in FIG. 3B, when two magenta colored lines 4*a* and one cyan colored line 4*b* are iterated concentrically outward from the center, the printed portion 3 appears to be a violet sphere having metallic gloss when visually observed. In this example, the line width D was set to 10 μm, and the spacing S was set to 10 μm. The concentric spacings S do not need to be even. Further, the circles of the respective lines 4 do not need to be concentric.

Figure 4A:
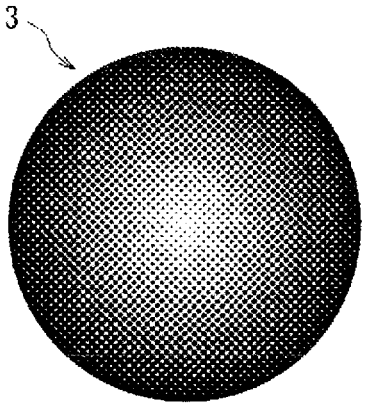
FIGS. 4A and 4B are sets of schematic diagrams illustrating an example of a line pattern, according to the first embodiment, with FIG. 4A illustrating the appearance as visually recognized from the front, and with FIG. 4B illustrating the line pattern.
Figure 4B:
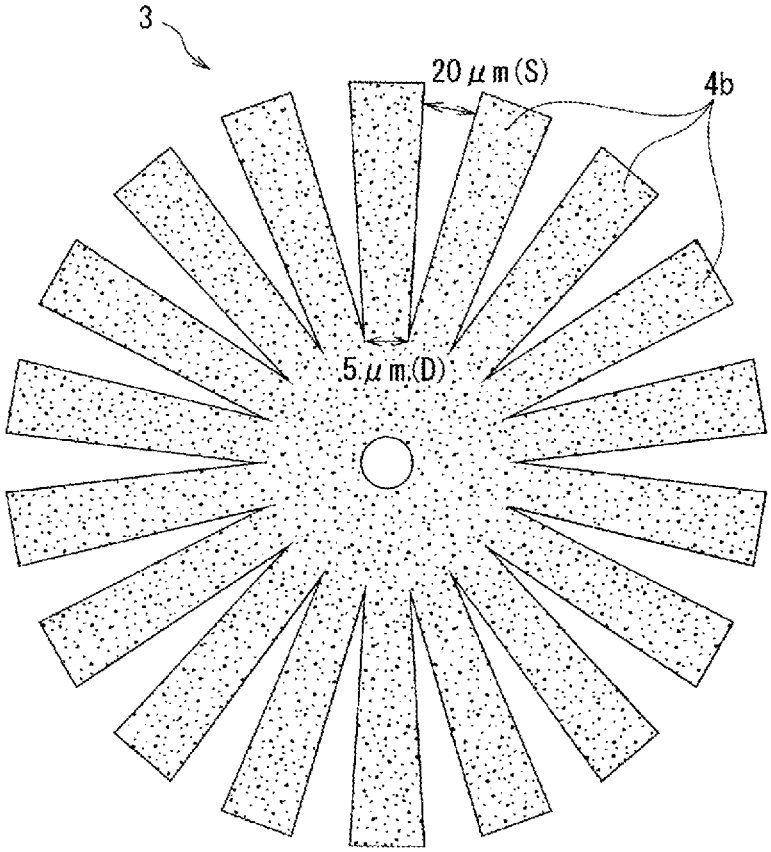

FIGS. 4A and 4B are sets of schematic diagrams illustrating a radial line pattern. FIG. 4A is a schematic diagram illustrating a printed portion 3 as visually recognized from the front, and FIG. 4B is an enlarged schematic diagram thereof. As shown in FIG. 4B, when a plurality of cyan colored lines 4*b* are arranged radially, printed portion 3 that appears to be a sphere as observed visually can be produced, with a hue different from FIG. 3A. In this example, the line width D was set to 5 μm, and the spacing S along the outermost circumference was set to 20 μm.

Figure 5A:
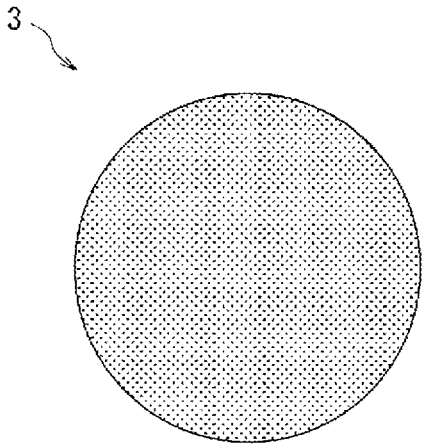
FIGS. 5A and 5B of schematic diagrams illustrating an example of a line pattern, according to the first embodiment, with FIG. 5A illustrating the appearance as visually recognized from the front, and with FIG. 5B illustrating the line pattern.
Figure 5B:
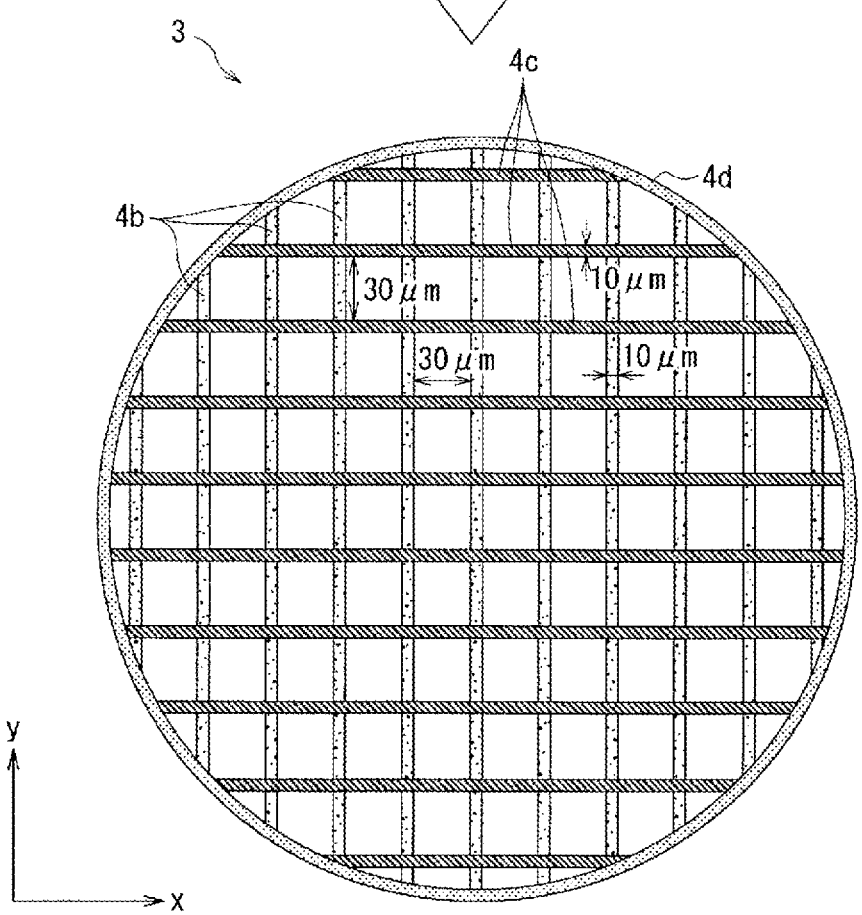

FIGS. 5A and 5B are sets of schematic diagrams illustrating a lattice-shaped line pattern. FIG. 5A is a schematic diagram illustrating a printed portion 3 as visually recognized from the front, and FIG. 5B is an enlarged schematic diagram thereof. FIG. 5B shows a lattice-shaped line pattern constituted of cyan colored lines (vertical lines) 4*b* arranged in the longitudinal direction (y-axis direction) as viewed in the figure, and yellow colored lines (horizontal lines) 4*c* arranged in the lateral direction (x-axis direction) as viewed in the figure. When a line 4*d* that is a cyan colored line serving as the contour is circularly arranged, the printed portion 3 can exert an expression, when visually observed, that appears to be a light-green sphere. In this example, the line width D of each cyan colored line 4*b* or yellow colored line 4*c* was set to 10 μm, and the spacing S was set to 30 μm. The intersection angle of the vertical lines relative to the horizontal lines does not need to be 90 degrees.

Figure 6A:
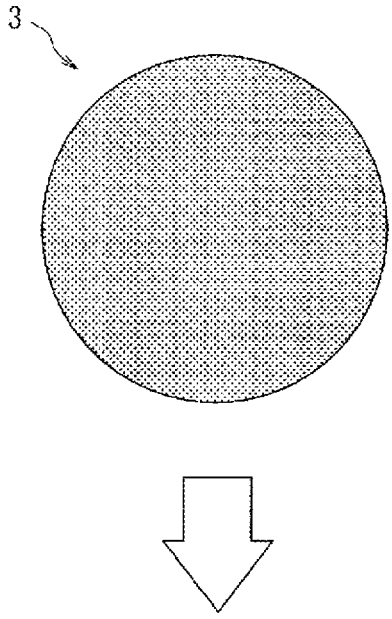
FIGS. 6A and 6B are sets of schematic diagrams illustrating an example of a line pattern, according to the first embodiment, with FIG. 6A illustrating the appearance pattern as visually recognized from the front, and with FIG. 6B illustrating the line pattern.
Figure 6B:
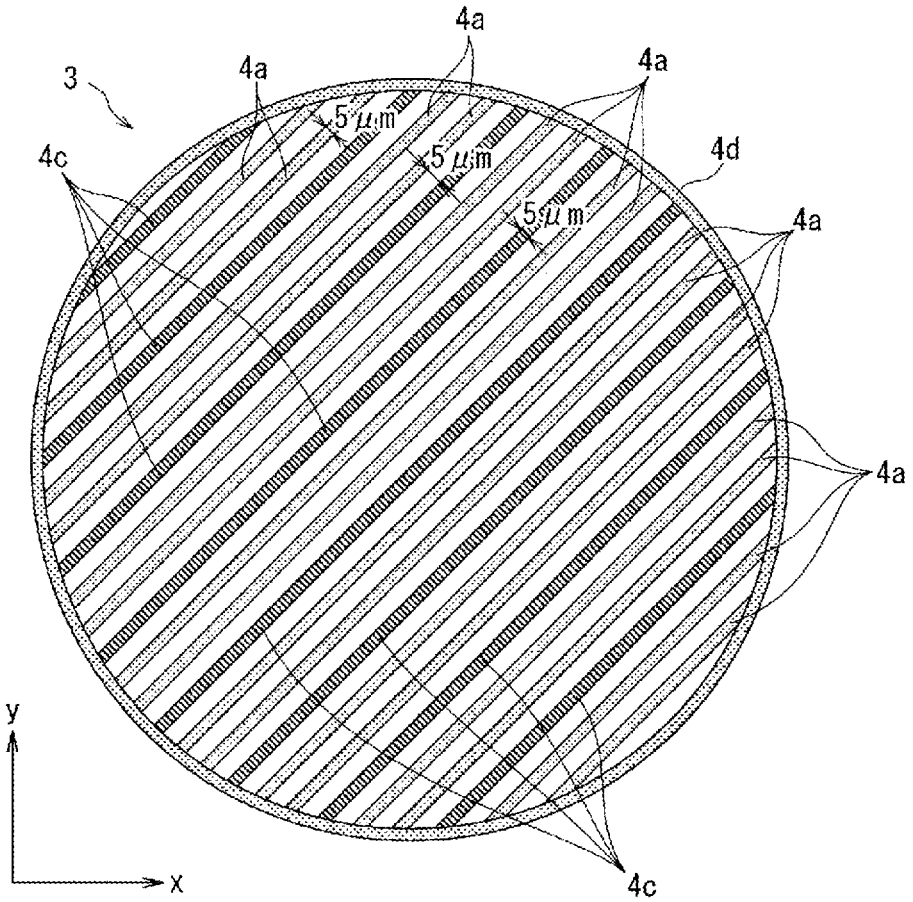

FIGS. 6A and 6B are sets of schematic diagrams illustrating a line pattern of unidirectionally arrayed lines 4. FIG. 6A is a schematic diagram illustrating a printed portion 3 as visually recognized from the front, and FIG. 6B is an enlarged schematic diagram thereof. FIG. 6B shows a line pattern constituted of iteration of two magenta colored lines 4*a* and one yellow colored line 4*c*. When a line 4*d* that is a magenta colored line serving as the contour is circularly arranged, the printed portion 3 can exert an expression, when visually observed, that appears to be a red sphere. In this example, the line width D of each magenta colored line 4*a* or yellow colored line 4*c* was set to 5 μm, and the spacing S was set to 5 μm. The lines 4 do not have to be parallel to each other. FIGS. 6A and 6B show a state in which the magenta colored lines 4*a* and the yellow colored lines 4*c* constituting a line pattern are inclined at 45° from the x-axis.

FIGS. 3A, 3B, 4A, 4B, 5A, 5B, 6A, and 6B show the cases of the printed portion 3 having a circular contour to simplify the line patterns. However, the contour of the printed portion 3 of the present embodiment should not be limited to a circle. The contour of the printed portion 3 may be polygonal, such as rectangular, or may have other shapes. For example, in the case of a concentric line pattern, polygonal lines 4 may be arranged with the centers being aligned. Moreover, the spacings S do not need to be even.

The color produced (visually recognized) in the printed portion 3 is determined by the combination of the colored lines 4. For example, red is reproduced based on the ratio of the three primary colors, with the area ratio of magenta colored line 4*a* to yellow colored line 4*c* being 2:1. Orange is reproduced based on the ratio of the three primary colors, with the area ratio of magenta colored line 4*a* to yellow colored line 4*c* being 1:2. Green is reproduced based on the ratio of the three primary colors, with the area ratio of cyan colored line 4*b* to yellow colored line 4*c* being 1:1. Indigo blue is reproduced based on the ratio of the three primary colors, with the area ratio of cyan colored line 4*b* to magenta colored line 4*a* being 2:1. Violet is reproduced based on the ratio of the three primary colors, with the area ratio of cyan colored line 4*b* to magenta colored line 4*a* being 1:2. Thus, ratio and arrangement of the plurality of colored lines 4 are designed depending on the color to be produced. In this case, the adjacent lines 4 are arranged, for example, as shown in FIG. 7, so that the color changes depending on the observation angle.

The printed portion 3 is preferably formed by intaglio printing because the ink that constitutes each line 4 is printed standing from the printing substrate 2. In this way, the printed portion 3 is formed by combining a plurality of colored lines 4 which are regularly arranged in a specific line pattern, with the colored lines 4 each standing. Thus, an uneven structure is formed by the plurality of colored lines 4. Therefore, by changing the visual observation angle relative to the surface of the printed matter 1 (printing substrate 2), light is permitted to interfere and color is permitted to appear varying. This is particularly effective when lines 4 of two or more colors are combined.

Each standing line 4 has a height of 1.5 μm or more, and preferably 2 μm or more, relative to the printing substrate 2. The unevenness of the lines 4 exerts a subtle stereoscopic effect. Regular arrangement of such lines 4 allows light to effectively interfere and, depending on the observation angle, more prominently change colors. In the case of a three-dimensional structure, visibility ratio of the plurality of colors changes depending on visual observation angles relative to the printing substrate 2, resulting in color changes.

Figure 7:
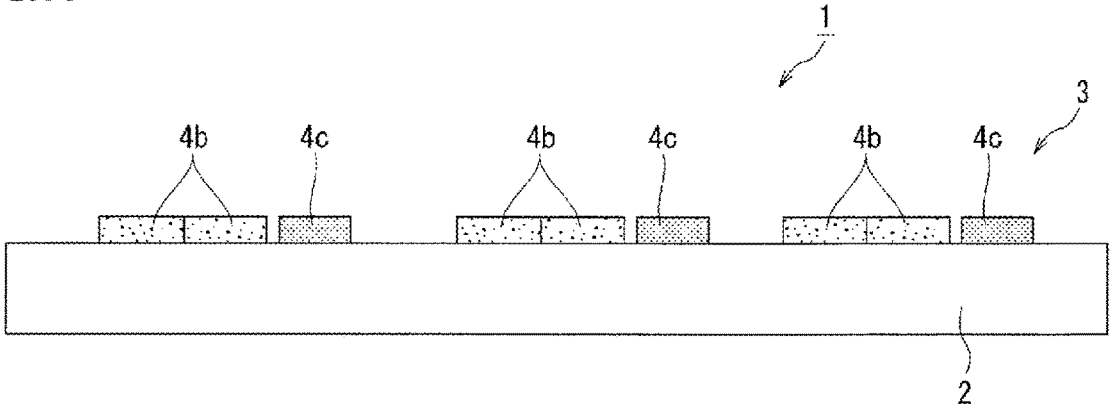
FIG. 7 is a cross-sectional view illustrating a color arrangement using two-color lines, according to the first embodiment.

For example, as shown in FIG. 7, when colored lines 4 of a uniform width are arranged such that a combination of three lines, i.e. cyan colored line 4*b*, cyan colored line 4*b*, and yellow colored line 4*c*, is iterated in a predetermined direction, the printed portion 3 appears to be green when observed from right above, but appears to be blue-green when observed from the cyan juxtaposed side, and yellowish green when observed from the yellow side. Thus, the visually recognized color can change depending on the viewing direction by designing the arrangement of the colored lines 4 of two or more colors in terms of direction.

Figure 8:
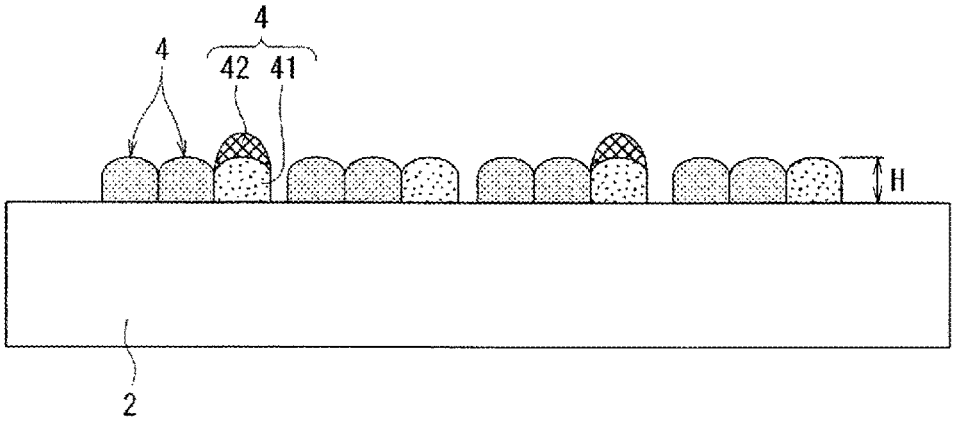
FIG. 8 is a cross-sectional view illustrating an example of a line pattern obtained by lamination, according to the first embodiment.
Figure 9:
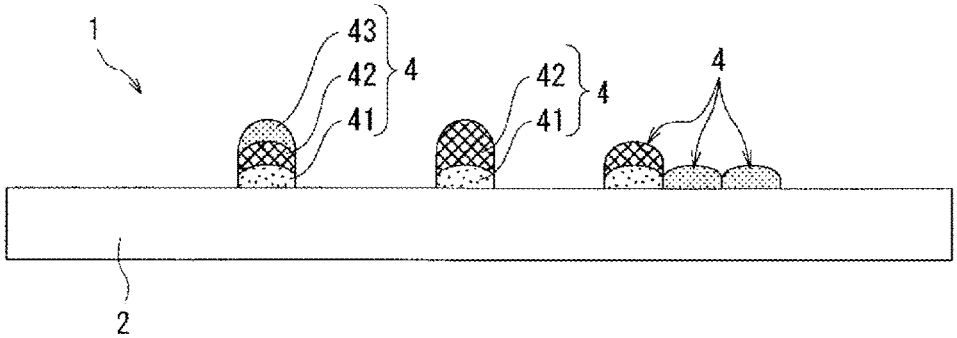
FIG. 9 is a cross-sectional view illustrating an example of a line pattern obtained by lamination, according to the first embodiment.

As shown in FIG. 8, an ink layer having a convex structure preferably has a height (layer thickness) H of 5 μm or less. This is because the upper limit thickness of a stable ink layer is about 5 μm in currently available gravure offset printing. The height may be larger than 5 μm, as long as a stable convex structure can be formed. As shown in FIG. 8, inks may be applied in two layers (printed twice) to form a multilayer lamination (two-layer lamination), so that the lines 4 concerned will have a height H larger than 5 μm. In FIG. 8, the two laminated ink layers are indicated by reference signs 41 and 42 in this order from the printing substrate 2 side. FIG. 9 shows an example of applying inks in two layers (printed 5 times) to laminate three layers. In FIG. 9, the three laminated ink layers are indicated by reference signs 41, 42, and 43 in this order from the printing substrate 2 side.

The plurality of lines 4 constituting a printed portion 3 may be varied in the height H. Due to variation in height, color change, which depends on visual observation angles, becomes finer and is highly defined. In this case, the height H of the highest line 4 is preferably 1.5 times or more the height H of the lowest line 4.

To permit the lines 4 of a convex structure to have variation in the height H, it is preferable to increase the height of part of lines 4 by laminating two or more different-color layers. In the case of multilayer structure, the height H of the second layer of each line 4 is preferably set to 1.5 times or more the height H of the first layer thereof. In this case, color change, which depends on visual observation angles, becomes finer and is highly defined.

Figure 10:
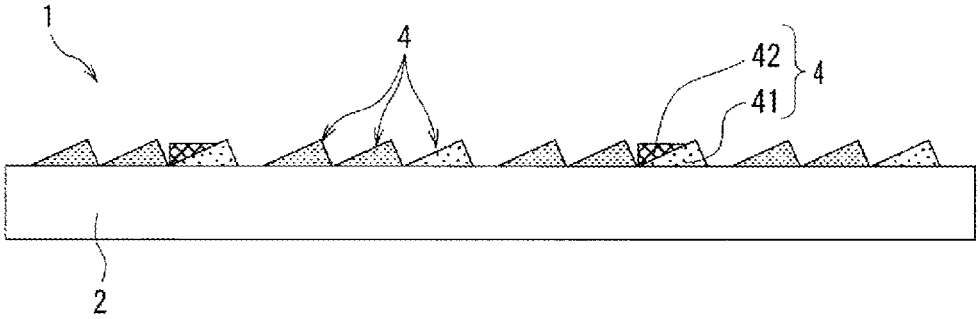
FIG. 10 is a cross-sectional view illustrating an example of a line pattern obtained by lamination, according to the first embodiment.

As shown in FIG. 10, a first layer as part of each line 4 may be formed of a line 41 having a triangular cross section, and a second layer of a line 42 with a flat upper surface may be laminated on the line 41.

Figures 11A, 11B, 11C:
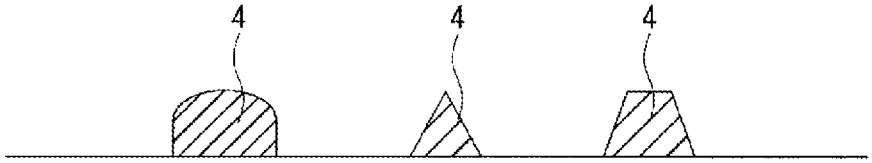
FIGS. 11A, 11B, and 11C are sets of cross-sectional views each illustrating a profile of a line constituting a line pattern, according to the first embodiment.

Each line 4 with a convex structure may have an upper cross-sectional profile as shown in FIGS. 11A, 11B, and 11C. Specifically, in the present embodiment, the cross-sectional profile of the line 4 may be semicircular, triangular, rectangular, or trapezoidal, or any other profiles. The cross-sectional profile in the present embodiment refers to one that is taken along a direction orthogonal to the direction in which the line 4 extends.

The printed portion 3 constituted of the plurality of lines 4 described above is preferably configured to have unevenness with a maximum height roughness Rz of 150 μm or less and an arithmetic average roughness Ra in the range of 1.0 μm or more and 7.0 μm or less. When the unevenness of the inks constituting the plurality of lines 4 is set within the above range relative to the surface of the printing substrate 2, color change appearing depending on visual observation angles is reliably ensured.

Figure 12:
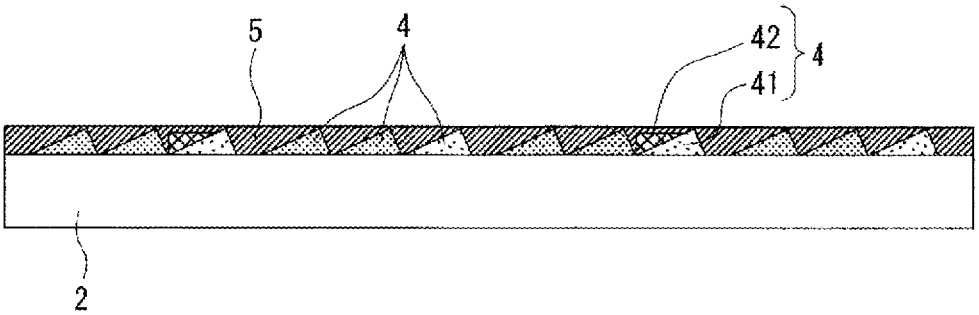
FIG. 12 is a cross-sectional view illustrating a line pattern including a surface protective layer, according to the first embodiment.

As shown in FIG. 12, a surface protective layer 5 made of a transparent resin, such as an acrylic resin, may be formed over the uneven printed portion 3 for protection of the same.

Moreover, as shown in FIGS. 10, 11B and 11C, each line 4 having a convex structure may have an upper cross-sectional profile including an inclined part serving as an inclined surface. The cross-sectional profiles of the lines 4 having a convex structure can be controlled by adjusting the cross-sectional profiles of the grooves formed in the printing plate for intaglio printing. The inclined surface, when included in the upper cross-sectional profile of each line 4 having a convex structure, can make the variety of color change richer when the printed portion 3 is obliquely observed relative to the printing substrate 2, and can randomize color change.

In the present embodiment, all or part of the plurality of lines 4 constituting the printed portion 3 does not necessarily need to have a convex structure. However, the convex structure, if provided, may exhibit prominent color change depending on visual observation angles. The lines 4 not having a convex structure may be formed by relief printing.

According to the present embodiment, high-definition printed matter (fine printed matter) 1 can be obtained by combining fine lines 4 and producing printing, such as a design pattern, that can be visually recognized as a series of colors. The printing substrate 2 is not limited to a sheet-shaped substrate, but may be a three-dimensional substrate, such as toys, and the three-dimensional substrate may have a surface where a printed portion 3 is formed.

As described above, the printed portion 3 provided to the printed matter 1 of the present embodiment can be produced with a preset specific line pattern so that light interference is permitted to occur. Therefore, for example, anticounterfeit effect or designability can be imparted to the printed matter 1 of the present embodiment, using a simple hologram.

The printed portion 3 constituted of the lines 4 described above, that is, the printed portion 3 having fine rises (convex structure) of inks, can be formed by, for example, intaglio printing based on gravure offset printing. An example of such printing will be described below.

(Overall Structure of Printing Device)

Figure 13:
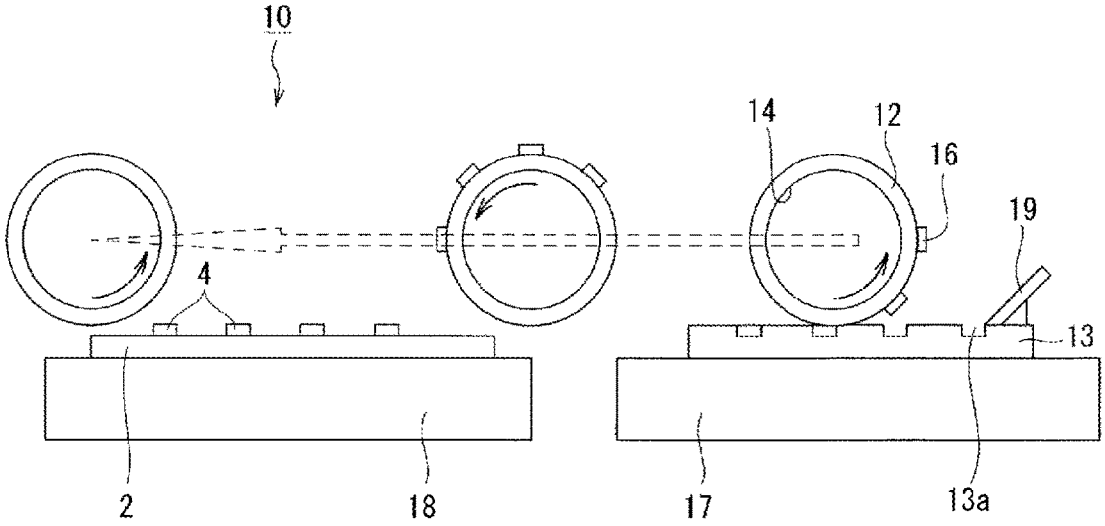
FIG. 13 is a conceptual diagram illustrating a configuration of a printing device for gravure offset printing, according to the first embodiment.

As shown in FIG. 13, a printing device 10 for gravure offset printing includes a printing plate 13 constituted of an intaglio plate, and a blanket 12 for transfer.

The printing plate 13 has a base material whose surface serving as a transfer surface is provided with concavities 13*a* conforming to the printed portion 3 to be printed. The concavities 13*a* are filled with an ink 16, and excess ink is scraped off with a doctor blade 19. The printing plate 13 is fixed to the upper surface of a printing plate-fixing platen 17.

The blanket 12 is fixed to a surface of a rotatable blanket body 14. The blanket body 14 is rotatably supported by a carriage (not shown), and the carriage is movably supported on a frame. The blanket 12 is rolled on the printing plate 13, so that the ink 16 is transferred from the concavities 13*a* of the printing surface of the printing plate 13 to the surface (printing surface) of the blanket 12. The transferred ink 16 is further transferred to the surface (printing surface) of the printing substrate 2 fixed to a substrate-fixing platen 18.

The blanket 12 performs transfer printing by delivering and receiving the ink 16 as mentioned above. The surface (i.e., printing surface) of the blanket 12 is formed of a rubber layer, for example. As the rubber material used for the rubber layer, or the blanket 12, various known materials can be used. A rubber material is selected so as to be suitable for the type of the ink 16 and the type of solvent used for the ink 16. For example, a material, such as silicone rubber, having solvent absorptivity is preferable.

Although the blanket 12 can be formed of the rubber layer alone, the rubber layer may be provided on the base substrate. The rubber layer formed of a rubber material can be provided by curing the rubber material on the base substrate, or bonding the rubber material to the base substrate. The base substrate, which is attached to the blanket body 14 at the time of printing, is constituted of, for example, a film or a thin metal plate having flexibility. However, in terms of cost and dimensional stability, the base substrate is preferably a polyester-based film such as of polyethylene terephthalate (PET), or a polyimide film. A primer layer or an adhesive layer may be provided, as necessary, between the base substrate and the rubber layer. Further, a cushion layer may be provided, as necessary, under the base substrate. A sponge-like material can be used for the cushion layer. The blanket 12 is tightly taken up at lateral ends thereof by the substantially cylindrical blanket body 14 using a mounting tool, not shown, and secured to the blanket body 14.

Although details are described later, the printing plate 13 is formed by forming a plurality of grooves (concavities 13*a*) conforming to the line pattern of the printed portion 3 on a metal plate made such as of copper or nickel, or a glass plate, and forming an antifriction film on a surface of the plate by chromium plating or carbon plating. Further, the upper surface of the antifriction film may be processed by, for example, applying, vapor-depositing, or sputtering diamond-like carbon, a fluorine- or silicone-based oil repellent agent to thereby improve surface smoothness.

In the present embodiment, to constitute the printed portion 3 with a plurality of lines 4, the concavities 13*a* for printing the printed portion 3 are constituted of a plurality of linearly extending grooves.

Then, the ink 16 is filled in the concavities 13*a* constituted of the grooves, and unnecessary ink is scraped off with the doctor blade 19.

Examples of the ink 16 filled in the concavities 13*a* include inks of three primary colors of light (red, green, and blue), inks of three primary colors of subtractive color mixture (yellow, magenta, and cyan), which are known in the field of printing, and inks of sumi (black). In the present embodiment, an ink corresponding to color development of one of four colors of cyan, magenta, yellow, and black is filled in the concavities 13*a*, for each printing plate 13.

As color development pigments for ink, disazo yellow, brilliant carmine, phthalocyanine blue, and the like that are used for process printing are well known. However, color development pigments are not limited to these materials, but organic pigments or inorganic pigments known in the field of printing may be suitably used.

Examples of the inorganic pigments include metal particles, oxides typified by titanium dioxide, zinc white, and iron black, hydroxide, sulfide, selenide, ferrocyanide, chromate, sulfate, carbonate, silicate, phosphate, carbon, and the like. Examples of the organic pigments include carbon compounds, nitroso-based pigments, nitro-based pigments, azo-based pigments, lake-based pigments, phthalocyanine-based pigments, condensed polycyclic materials, luminous or afterglow pigments, and metal oxides or quantum dots that emit light in response to light of a specific wavelength, such as ultraviolet rays or infrared rays.

These pigments may be used singly or as a mixture of two or more.

To achieve electrical conductivity, the pigments for these colors may be mixed with fine metal particles, fine particles of conductive metal oxide, metal nanowires or metal chloride, or conductive polymers, such as conductive polyaniline, conductive polypropylene pyrrole, and conductive polythiophene (complex of polyethylene dioxythiophene and polystyrene sulfonate).

As the solvent contained in an ink, for example, dodecane or tetradecane is used. The solvent contained in an ink may be any solvent. For example, a low-boiling-point solvent (MEK, ethanol, acetone, etc.) that dries at ordinary temperature may be used for a quick drying ink; water (purified water) may be used for a water-based ink; and oil (aliphatic hydrocarbon, glycol ether, higher alcohol, etc.) that is not evaporated at ordinary temperature may be used for an oil-based ink. Depending on the type of solvent, it is preferable to select a material for the blanket 12 which has absorptivity for the solvent.

The resin material used as an ink material other than a pigment may be a transparent resin, colored resin, or opaque resin. That is, for example, a general-purpose plastic, such as a thermoplastic resin or a thermosetting resin, may be used. Specific examples of the general-purpose plastic include a polycarbonate resin, acrylic resin, fluorine-based acrylic resin, silicone-based acrylic resin, epoxy acrylate resin, polystyrene resin, acrylonitrile-styrene resin, cycloolefin polymer, methylstyrene resin, fluorene resin, PET (polyethylene terephthalate), polypropylene, phenol resin, melamine resin, PEN (polyethylene naphthalate), PI (polyimide), and the like.

Examples of the thermoplastic resin include PET (polyethylene terephthalate), PC (polycarbonate), PS (polystyrene), COC (cyclic olefin copolymer), PMMA (polymethyl methacrylic acid (polymethyl methacrylate, acrylic resin)), COP (cycloolefin polymer), MS (methacrylic acid-styrene copolymer), AS (acrylonitrile-styrene copolymer), PMMA (polymethyl methacrylic acid (polymethyl methacrylate, acrylic resin)), PEN (polyethylene naphthalate), PI (polyimide), and like the like.

Examples of the thermosetting resins include ones well known in the art, such as phenol resins, melamine resins, epoxy resins, alkyds, and the like.

Besides the materials mentioned above, examples of the resin material used as an ink material include an engineering plastic, such as PBT (polybutylene terephthalate), POM (polyoxymethyl), PA (polyamide), or PPS (polyphenyl sulfide); and a super engineering plastic. In addition, resins that are cured by ionizing radiation, such as an acrylic resin, urethane resin, epoxy resin, polyester resin, and thiol resin, may also be used.

(Light-Scattering Particles to be Mixed)

The ink may be mixed with light-scattering particles. Specifically, light-scattering particles may be contained in any of the inks of different color phases constituting the printed matter 1, or may be contained in any of the plurality of laminated layers.

As the light-scattering particles mixed in the ink, for example, spherical or amorphous particles may be used. Examples of the light-scattering particles include inorganic fine particles and organic fine particles.

Specific examples of the light-scattering particles include acrylic particles, styrene particles, styrene acrylic particles, and crosslinked products thereof; melamine-formalin condensate particles; polyurethane-based particles, polyester-based particles, silicone-based particles, fluorine-based particles, epoxy particles, and copolymers thereof; clay compound particles, such as smectite, kaolinite, and talc; inorganic oxide particles, such as silica, titanium oxide, alumina, silica alumina, zirconia, zinc oxide, barium oxide, and strontium oxide; and inorganic fine particles, such as calcium carbonate, barium carbonate, magnesium carbonate, barium chloride, barium sulfate, barium nitrate, barium hydroxide, aluminum hydroxide, strontium carbonate, strontium chloride, strontium sulfate, strontium nitrate, strontium hydroxide, and glass particles.

These kinds of transparent particles having a high refractive index may be used singly or as a mixture of two or more. Further, inorganic fine particles or organic fine particles may be surface-treated by coating, vapor deposition, or the like, and these kinds of particles may be used singly or as a mixture of two or more. That is, the light-scattering particles to be mixed may include at least two kinds of light-scattering particles having different refractive indices.

The light-scattering particles to be mixed may include two or more kinds of light-scattering particles having different hazes, instead of two or more kinds of light-scattering particles having different refractive indices. Instead of mixing light-scattering particles, the ink that has constituted the lines 4 may contain voids that contain air therein. For example, a foaming agent may be incorporated into the material of the ink to be printed, and the foaming agent may be foamed to form voids.

The printing substrate 2 of the present embodiment has an upper surface on which a printing layer containing the printed portion 3 is formed by printing. The printing layer does not need to be formed on the overall upper surface of the printing substrate 2. Further, printing other than the print pattern of the present embodiment may be produced.

Examples of the printing substrate 2 include a glass plate, such as soda lime glass, low alkali borosilicate glass, and non-alkali aluminum borosilicate glass; a plastic plate or a plastic film made of polyethylene terephthalate (PET), triacetyl cellulose (TAC), polymethyl methacrylate (PMMA), or polycarbonate (PC); processed paper known in the art, such as clean paper, coated paper, or calendar paper; a water-soluble polymer known in the art, such as sodium polyacrylate, polyvinyl alcohol, or polyethylene oxide; and a biocompatible polymer known in the art, such as polylactic acid, polyglycolic acid, or polycaprolactone.

The printing substrate 2 is not limited to a sheet-shaped material, but may be a hollow or solid material. Moreover, any flat surface or curved surface may be used as a printing surface on which the printed portion 3 is formed.

(Printing Method)

Next, a printing method will be described.

As shows in FIG. 7, when the printed portion 3 is constituted of, for example, colored lines 4 of two colors, two kinds of printing plates 13 are separately prepared for the respective colors to be printed, and intaglio printing is performed sequentially using the two printing plates 13. The printing plates 13 are prepared for the respective colors to be printed as mentioned above. When multilayer coating is performed as well, printing plates 13 are prepared for the respective number of laminated layers, and intaglio printing is sequentially performed.

The depth and width of the grooves constituting the concavities 13*a* may be changed for each printing plate 13. Alternatively, the width and depth of part of the grooves formed on a printing plate 13 may be designed to be different from the width and depth of other grooves.

The following description addresses one intaglio printing process using one printing plate 13. When intaglio printing is performed several times, the above print process may be iterated.

The printing plate 13 is immersed in an ink, for example, in an ink reservoir (not shown). Subsequently, while the ink is guided to the concavities 13*a* of the printing plate 13, the extra ink overflowing to the surface of the printing plate 13 is removed by the doctor blade 19. Thus, as shown in FIG. 13, the ink 16 can be filled in the concavities 13*a* of the printing plate 13. In this case, the velocity of the doctor blade 19 is preferably set to any value within the range of 5 mm/sec to 300 mm/sec, depending on the viscosity change of the ink due to shearing stress of the doctor blade 19.

Next, with the movement of the carriage (not shown) and the axial rotation of the blanket body 14 in the arrowed directions of FIG. 13, the printing surface of the blanket 12 is continuously brought into contact with the ink 16 filled in the printing plate 13. Thus, the ink 16 is transferred to the printing surface of the blanket 12. For example, the rate of transfer to the blanket 12 may be 10 mm/sec. In this case, if the printing surface of the blanket 12 is made of a material having absorptivity to absorb the solvent of the ink 16, the wet-spread of the ink 16 on the printing surface of the blanket 12 is minimized. Thereafter, with the movement of the carriage, the blanket 12 to which the ink 16 has been transferred is moved to the position where the printing substrate 2 is placed.

Subsequently, as shown on the left in FIG. 13, with the movement of the carriage and the axial rotation of the blanket body 14, the ink 16 transferred to the blanket 12 is transferred to the printing surface of the printing substrate 2. That is, the rotating blanket 12 is pressed against the printing substrate 2 to transfer the ink 16. It is so designed that the rotational speed of the printing surface of the blanket 12 synchronizes with the moving speed of the carriage. For example, the rate of transfer to the printing substrate 2 may be 100 mm/sec. Portions of the ink 16 remained on the printing surface of the blanket 12 without being transferred are removed by, for example, a cleaning roller, not shown. The present embodiment exemplifies the case where the carriage is moved during transfer. However, as long as the positional change of the blanket body 14 relative to the printing plate-fixing platen 17, and of the blanket body 14 relative to the substrate-fixing platen 18 is achieved, the members to be moved may be the printing plate-fixing platen 17 and the substrate-fixing platen 18, or the three members, i.e. the carriage, the printing plate-fixing platen 17, and the substrate-fixing platen 18.

Subsequently, the ink 16 transferred to the printing substrate 2 is cured. Various methods may be used for this curing according to the type and the components of the ink to be used. Examples of the methods include baking, heating, natural drying, ionizing radiation curing, cooling (in the case of using electrically conductive ink containing a thermoplastic material), and the like. When heating is used, for example, an infrared heater may be used. The printed matter 1 is obtained by using these curing methods singly or in combination of two or more.

The printing device 10 may have such a function that the solvent absorbed by the blanket 12 is dried during print standby, if the swelling amount of the blanket 12 has reached a predetermined reference value.

The material of the printing surface of the blanket 12, the type of ink used, and the type of solvent in the ink can be selected from variety of items other than those mentioned above.

Although the blanket 12 is fixed to the cylindrical blanket body 14, the printing surface of the blanket 12 used at the time of ink transfer may have a curved surface or a flat surface other than cylindrical surface. The printing substrate 2 may have a curved printing surface, as a resin-molded article does, other than a sheet-like surface.

(Formation of Printing Plate)

The printing plate 13 of the present embodiment is formed by cutting the surface of a printing plate base material 9. The concavities 13*a* of the printing plate 13 of the present embodiment are formed of a plurality of linear grooves conforming to the contour and the line pattern of the printed portion 3 to be printed. According to the conventional art, a group of concavities corresponds to the dots which conform to halftone dots. In this regard, in the present embodiment, the concavities 13*a* of the printed portion 3 are formed of linear grooves conforming to the lines 4 constituting the printed portion 3.

Figure 14:
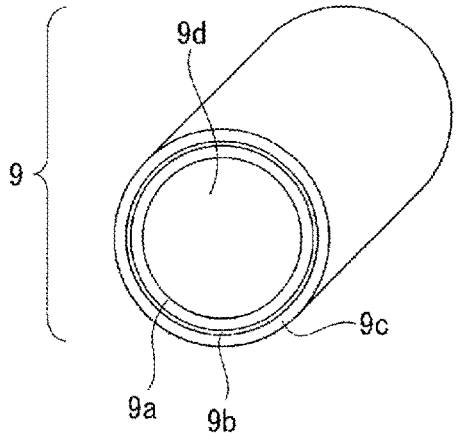
FIG. 14 is a conceptual diagram illustrating a configuration of a printing plate base material, according to the first embodiment.

As shown in FIG. 14, the printing plate base material 9 is formed such that, for example, a copper plating layer 9*a*, a release layer 9*b*, and a copper Ballard layer 9*c* are concentrically laminated radially outward in this order on a surface of a cylindrical body 9*d* made of Al, Ni or Fe.

When forming grooves, a plurality of concavities 13*a* constituted of linear grooves are formed by rotating the printing plate base material 9 about the center axis, and performing cutting by allowing a cutting blade to act on the copper Ballard layer 9*c* in the radial direction.

The cutting depth is 20 μm, for example. The concavities 13*a* constituted of grooves may extend in the circumferential direction of the printing plate base material 9, or extend in a spiral direction. The concavities 13*a* constituted of grooves may extend in the circumferential direction by alternating formation of a concavity 13*a* by cutting (cutting movement), and the relative movement of the printing plate base material 9 and the cutting blade along the rotational axis (feed movement). The concavities 13*a* can extend in the spiral direction by performing cutting movement and feed movement simultaneously and continuously. The width of each concavity 13*a* may be changed by changing the cutting depth of the cutting blade toward the axis continuously or stepwise. When the lines 4 to be printed extend being zigzagged, the grooves are also formed being zigzagged.

The width and depth of each concavity 13*a* are determined according to the line pattern to be formed and the rise (height H) of each line 4 formed of an ink. Thus, when the ink 16 is transferred to the printing substrate 2 using the printing plate 13, the line width D and the height H of the ink transferred to the printing substrate 2 affect the obtained printed matter 1, i.e. affect the line pattern to be formed and to the rise (height H) of the lines 4 of the ink 16. Thus, color gradation of the printed matter 1 can be expressed by changing the occupancy of ink per unit area, or by making the line width D of each line 4 different even if the ink area remains unchanged.

In the present embodiment, the concavities 13*a* are formed using a cutting blade. The cutting blade has a single nose part and two skew parts holding the nose part. The skew parts extend in a direction non-parallel and non-perpendicular to the cutting direction of the cutting blade. The cutting blade preferably has at least one skew part adjacent to the nose part.

The cutting blade used for producing the printing plate 13 of the present embodiment has a single nose part and two skew parts holding the nose part. The directions of extending the two skew parts are different from each other relative to the cutting direction of the cutting blade, and the angle formed between one skew part and the cutting direction can be selected as desired.

Figure 15A:
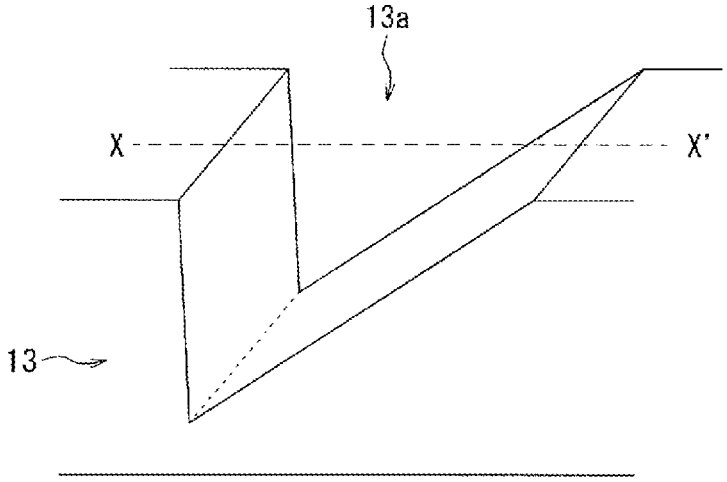
FIGS. 15A and 15B are sets of conceptual diagrams illustrating a configuration of concavities of a printing plate, according to the first embodiment, with FIG. 15A being a perspective view, and FIG. 15B being a plan view.
Figure 15B:
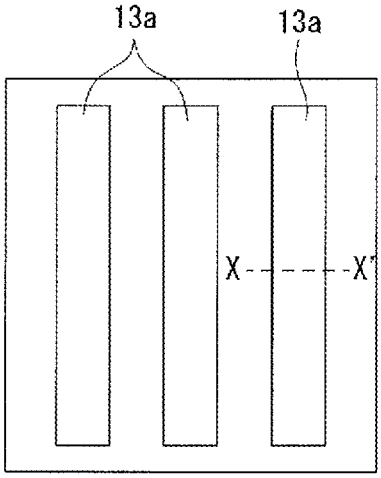

Following such a cutting process, a chromium plating layer (not shown) is formed on the entire surface of the copper Ballard layer 9*c* to increase abrasion resistance. Further, DLC (diamond-like carbon) may be formed (not shown) on the chromium plating layer by vapor deposition to improve surface smoothness. Then, the copper Ballard layer 9*c* is peeled from the release layer 9*b*, thereby obtaining a flat printing plate 13, as shown in FIGS. 15A and 15B, having concavities 13*a*.

Figure 16A:
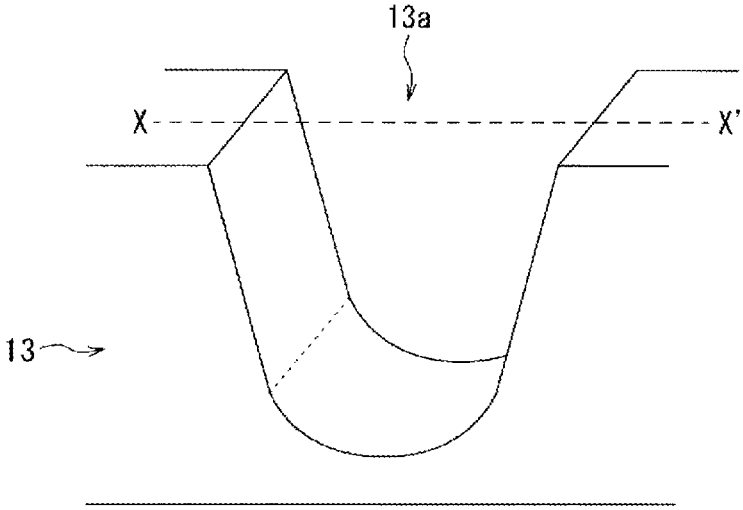
FIGS. 16A and 16B are sets of conceptual diagrams illustrating a configuration of concavities of a printing plate, according to the first embodiment.
Figure 16B:
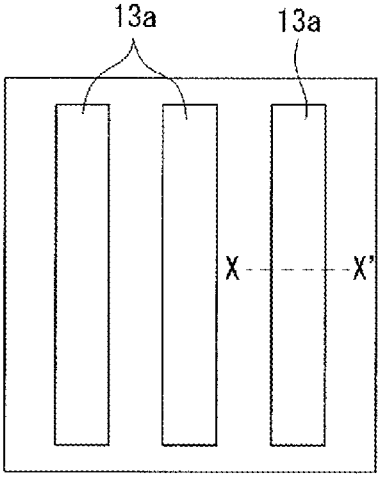

The concavities 13*a* of the present embodiment may each have a profile that is linearly symmetric or asymmetric about the depth direction, or a profile that is a combination of at least one or more kinds of profiles. FIGS. 15A, 15B, 16A, and 16B show an example of the profile of each concavity 13*a* of the present embodiment. FIGS. 15A and 15B are sets of conceptual diagrams illustrating an example of the concavity 13*a* of the printing plate 13, with FIG. 15A being a perspective view, and FIG. 15B being a plan view. FIGS. 16A and 16B are sets of conceptual diagrams illustrating an example of the concavity 13*a* of the printing plate 13, with FIG. 16A being a perspective view, and FIG. 16B being a plan view.

In the present embodiment, the printing plate 13 is produced using a cutting blade. However, for example, the printing plate 13 may be produced by cutting, using a dicing saw, a laser, or a machining center. Alternatively, the printing plate 13 may be produced by multi-step etching or multi-step electroplating.

Moreover, in the present embodiment, a metal member is used as a plate. However, a plate obtained by transferring convexities of quartz or metal to a resin may be used as the printing plates 13.

The ink 16 transferred to the printing substrate 2 by the printing device 10 including the printing plate 13 of the present embodiment may have a thickness that is 5 μm or less per layer. The printed matter 1 may be formed of a single ink layer. The same processing may be performed again on the ink 16 transferred to the printing substrate 2 to laminate the same or different ink 16. Thus, for example, laminated lines 4 shown in FIG. 10 or 12 can be printed.

Moreover, using an alignment function, an ink 16 that is the same or different from the ink 16 transferred to the printing substrate 2 may be transferred as a monolayer or a multilayer at a desired interval from the first transferred ink 16.

By curing or baking the ink 16 transferred to the printing substrate 2 by the printing device 10 including the printing plate 13 of the present embodiment, printed matter 1 is obtained in which a printed portion 3 is formed, as shown in FIG. 8, on the printing substrate 2. FIG. 8 shows a cross-sectional profile perpendicular to the printing surface of the printing substrate 2. As shown in the figure, the cross-sectional profile of each line 4 after being transferred and dried is symmetric or asymmetric in conformity with the cross-sectional profile of the concavities 13*a*.

Second Embodiment

Figure 17:
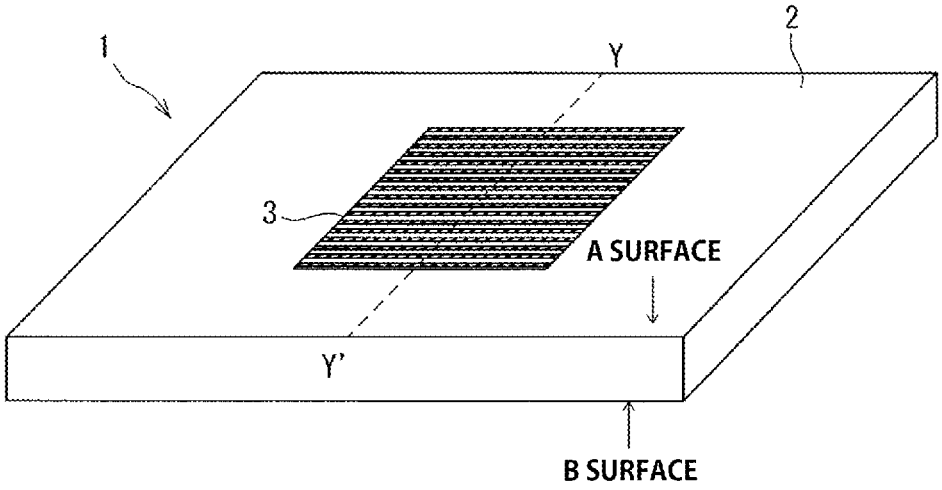
FIG. 17 is a conceptual diagram illustrating a configuration of printed matter, according to a second embodiment.

As shown in FIG. 17, printed matter 1 according to the present embodiment has a printed portion 3 on part of a surface of a printing substrate 2. The printed portion 3 is constituted of printing, such as a design pattern, formed of an ink and visually recognized as a continuous color pattern. The printing constituting the printed portion 3 does not always need to be configured so that a clear pattern, such as design pattern, can be visually recognized. The printed portion 3 of the present embodiment may be arranged at two or more positions on the printing substrate 2.

In the printed matter 1 according to the present embodiment, the printing substrate 2 and the printed portion 3 have a total thickness, for example, in the range of 5.0 μm or more and 300.0 μm or less. The printing substrate 2 may have printed portions other than the printed portion 3 of the present embodiment. The printed portion 3 of the present embodiment may be arranged as part of a printed portion that is other than the printed portion 3 of the present embodiment. The printed portion other than the printed portion 3 of the present embodiment, for example, may be a design pattern or other printing that is a group of halftone dots as in the conventional art.

Figure 18A:
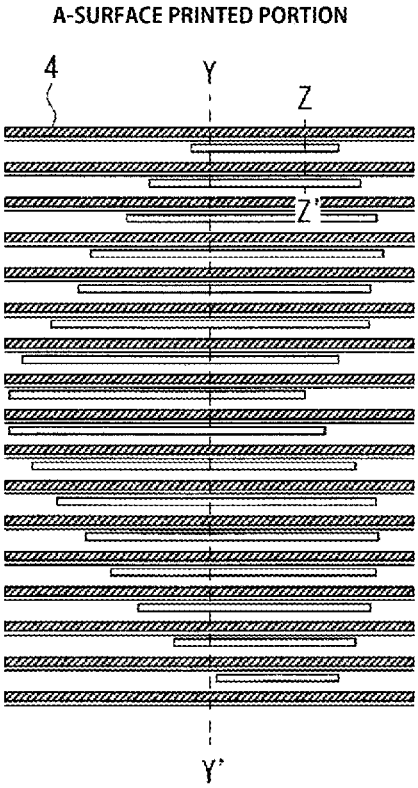
FIGS. 18A and 18B are sets of conceptual diagrams illustrating a configuration of a printed portion, according to the second embodiment, with FIG. 18A being a diagram as viewed from an A-surface side, and with FIG. 18B being a diagram as viewed a B-surface side.
Figure 18B:
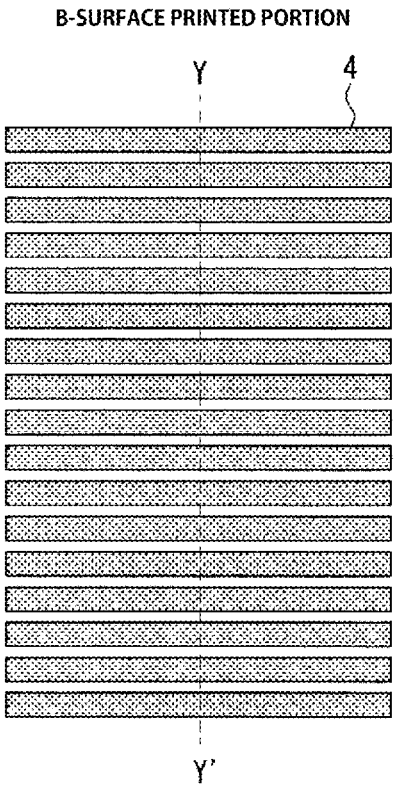
Figure 19:
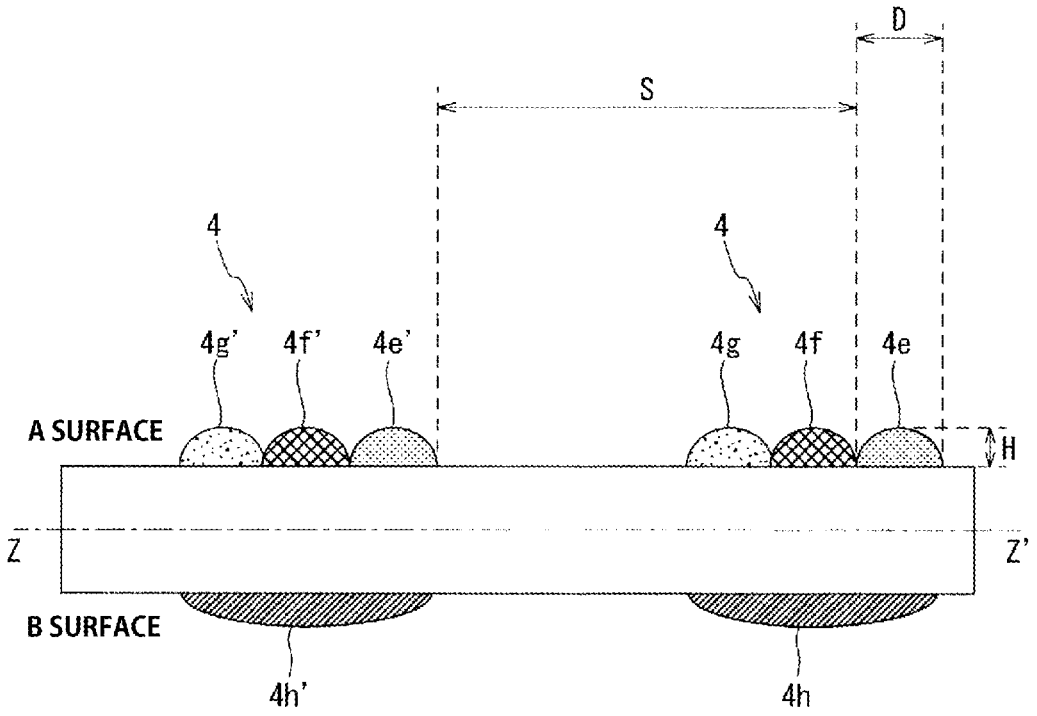
FIG. 19 is a cross-sectional view illustrating a configuration of a printed portion, according to the second embodiment.

As shown in FIGS. 18A and 18B, for example, in the present embodiment, the printed portion 3 formed of a design pattern or other printing is configured by combining a plurality of lines 4. The lines 4 of the present embodiment each have a line width D that cannot be visually recognized. The line width D is 100 μm or less, for example. In this case, as shown in FIG. 19, fine color printing can be produced by constituting the printed portion 3 with a combination of colored lines 4 having at least one or more colors selected from, for example, four colors of cyan, magenta, yellow, and black. FIG. 18A shows a structure of a printed portion 3 formed on an A surface of a printing substrate 2. Further, FIG. 18B shows a structure of a printed portion 3 formed on a B surface of the printing substrate 2.

FIG. 19 shows lines 4 producing the printed portion 3. As shown, each line 4 has a pattern constituted of a plurality of lines 4*e*, 4*f*, and 4*g*. In this case, the interval between the lines 4*e* and 4*f* corresponding to each other in adjacent lines 4 is the spacing S. If the pattern constituting the lines 4 includes only the lines 4*e* and 4*e*' (monolayer coating), the spacing S shown in FIG. 19 is naturally provided.

The arrangement of the plurality of lines 4 producing the printed portion 3 is set such that the spacing S between two adjacent lines 4 is 50 times or less the line width D of the line 4 that is the narrower one of the two lines 4 defining the spacing S. A color pattern can be visually recognized as continuous by setting the size of the spacing S to 50 times or less the line width D.

If the size of the spacing S exceeds 50 times the line width D, the non-printed portion (spacing S) between the lines may be visually recognized. The lines 4 may intersect with each other, and in this case the interval (spacing S) at the intersection is naturally 0.

In the present embodiment, the plurality of lines 4 producing the printed portion 3 are formed using intaglio plates as in the first embodiment. As shown in FIG. 19, lines 4*h* and 4*h*' may be arranged, on the same single surface, in a specific line pattern using one intaglio plate. Furthermore, as shown in FIG. 19, lines 4*e*, 4*f*, and 4*g*, and lines 4*e*', 4*f*, and 4*g*' may be arranged in a specific line pattern, by performing printing using two or more different intaglio plates, with the alignment being adjusted. When printing is performed using different intaglio plates, there may be or may not be provided a spacing between the lines. However, it is preferable to provide a spacing of 2 μm or more to avoid color mixing.

Figure 20:
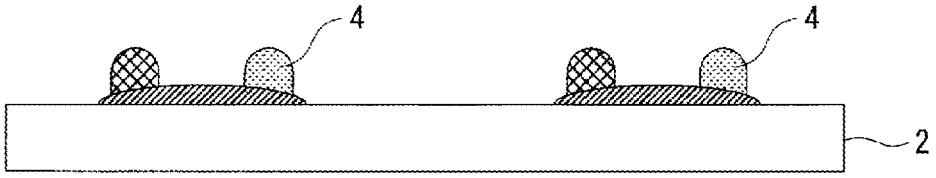
FIG. 20 is a cross-sectional view illustrating an example of a line pattern obtained by lamination, according to the second embodiment.
Figure 21:
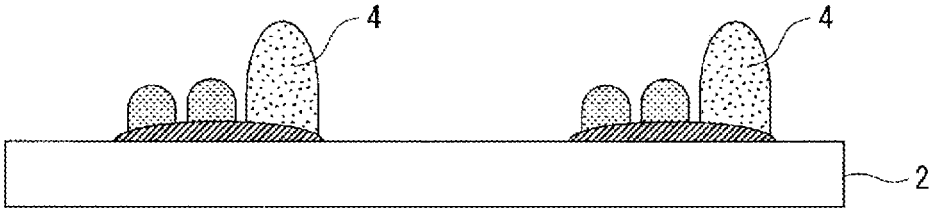
FIG. 21 is a cross-sectional view illustrating an example of a line pattern obtained by lamination, according to the second embodiment.

The plurality of lines 4 producing the printed portion 3 may be laminated on the same single surface, as shown in FIG. 20, by performing printing using different intaglio plates, with the alignment being adjusted. In this case, a single intaglio plate may be used for laminating the lines to thereby make only specific parts higher.

When the plurality of lines 4 are unidirectionally arranged to constitute the printed portion 3, color gradation to be produced in the printed portion 3 (color gradation of the printed portion 3) is adjusted by changing the line width D of the lines 4 arranged in a unit area.

Moreover, according to the present embodiment, even if the ink area remains unchanged, color gradation can be adjusted by changing the line width D. Color gradation control by change of the line width D has already been described in the first embodiment. Therefore, details are omitted herein.

In the present embodiment, when the printed portion 3 is constituted of a plurality of lines 4, the plurality of lines 4 are arranged in a specific line pattern to give expression to the printed portion 3. The arrangement of the specific line pattern made up of this plurality of lines 4 has already been described in the first embodiment. Therefore, details are omitted herein.

The following description deals with examples of the printed portion 3 constituted of a combination of a plurality of colored lines 4.

Figure 29:
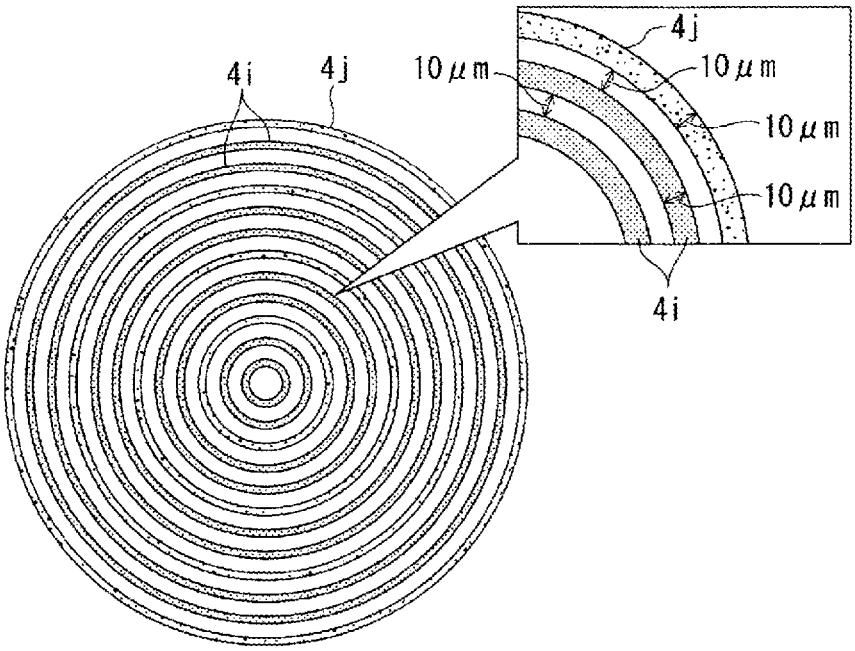
FIG. 29 is a schematic diagram illustrating an example of a line pattern, according to the second embodiment.

FIG. 29 is a schematic diagram illustrating a concentric line pattern which is substantially the same as one shown in FIG. 3B. As shown in FIG. 29, when two magenta colored lines 4*i* and one cyan colored line 4*j* are concentrically iterated outward from the center, the printed portion 3 appears to be a violet sphere exhibiting metallic gloss when visually observed. In this example, the line width D was set to 10 μm, and the spacing S was set to 10 μm. The spacings S between concentric lines do not need to be set equal. Further, the circles of the respective lines 4 do not need to be concentric.

Figure 30:
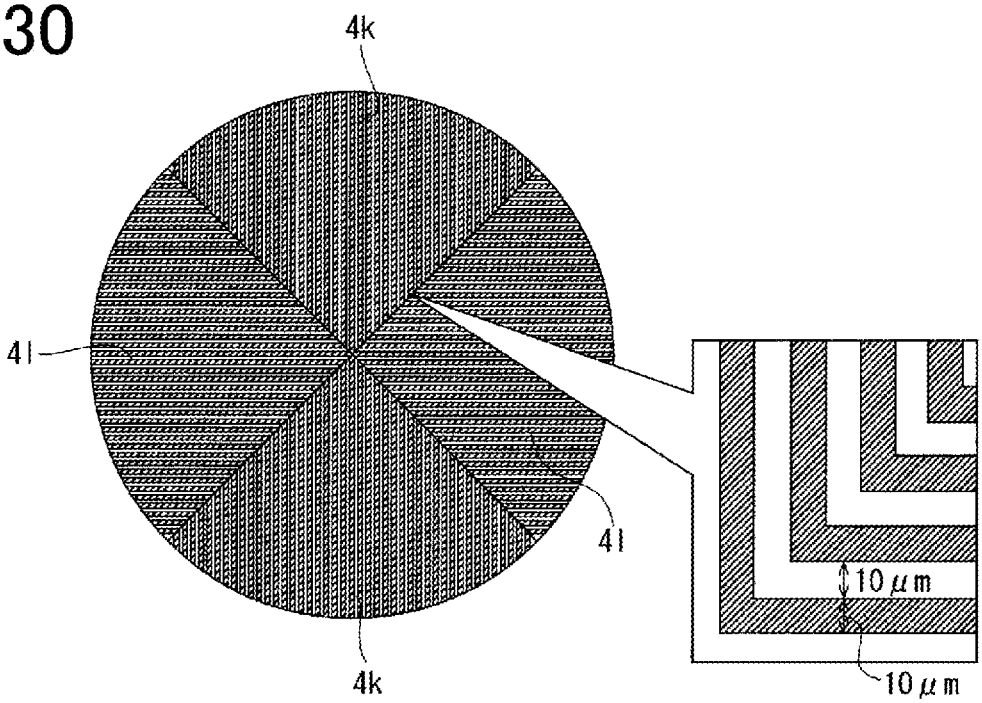
FIG. 30 is a schematic diagram illustrating an example of a line pattern, according to the second embodiment.

FIG. 30 is a schematic diagram illustrating a line pattern of straight lines which are orthogonal to each other on a sector basis, the sectors being defined at a 90°-interval. As shown in FIG. 30, when the straight lines orthogonal to each other on a sector basis have the same color, the printed portion 3, when visually observed, appears to be a different color due to interference of light, even if the lines 4*k* and 4*l* have the same width and are arranged at even intervals. In this example, the line width D was set to 10 μm, and the spacing S was set to 10 μm. The concentric spacings S do not need to be even.

Figure 31:
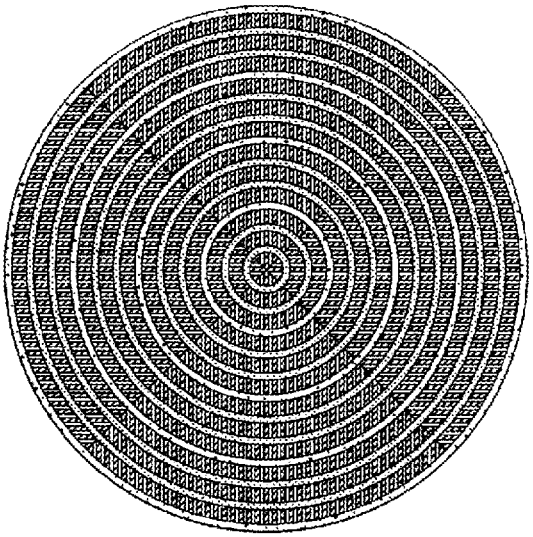
FIG. 31 is a schematic diagram illustrating an example of a line pattern, according to the second embodiment.

FIG. 31 is a schematic diagram obtained by concentrically arranging the line patterns shown in FIGS. 29 and 30 on the front and back surfaces (A surface and B surface), respectively, of the printing substrate 2. As shown above, these patterns are individually visually recognized as having colored metallic gloss or as having different colors depending on viewing angles. However, when these patterns on the front and the back are combined, the design pattern as produced will exhibit metallic gloss with different colors depending on viewing angles.

Figure 32:
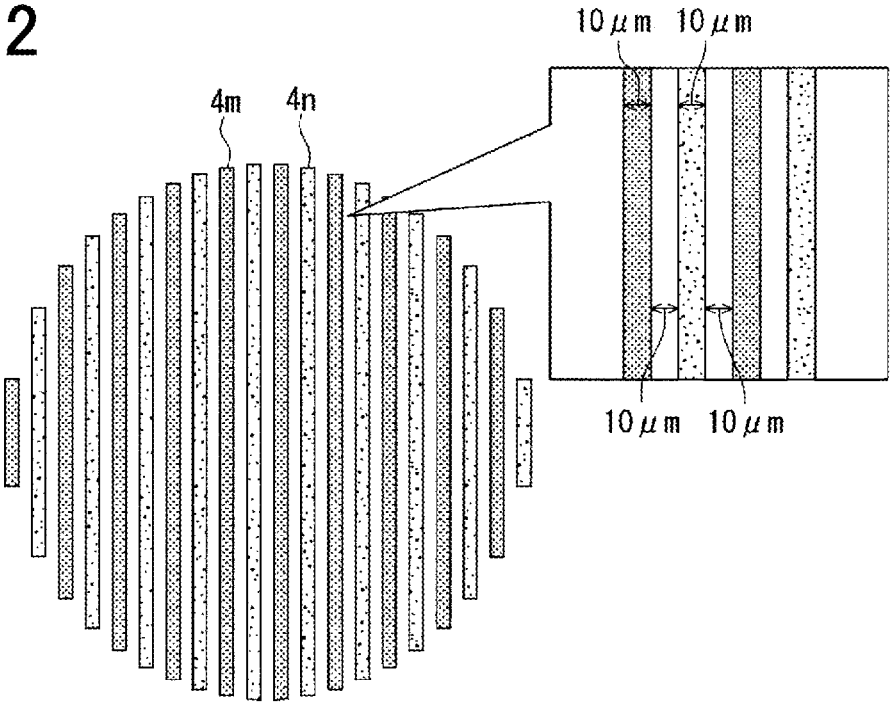
FIG. 32 is a schematic diagram illustrating an example of a line pattern, according to the second embodiment.

FIG. 32 is a schematic diagram illustrating a line pattern in which lines 4 are unidirectionally arranged. As shown in FIG. 32, cyan colored lines 4*m* and yellow colored lines 4*n* are iterated to produce a green spherical printed portion 3. In this example, the line width D was set to 10 μm, and the spacing S was set to 20 μm. The lines need not be parallel to each other.

Figure 33:
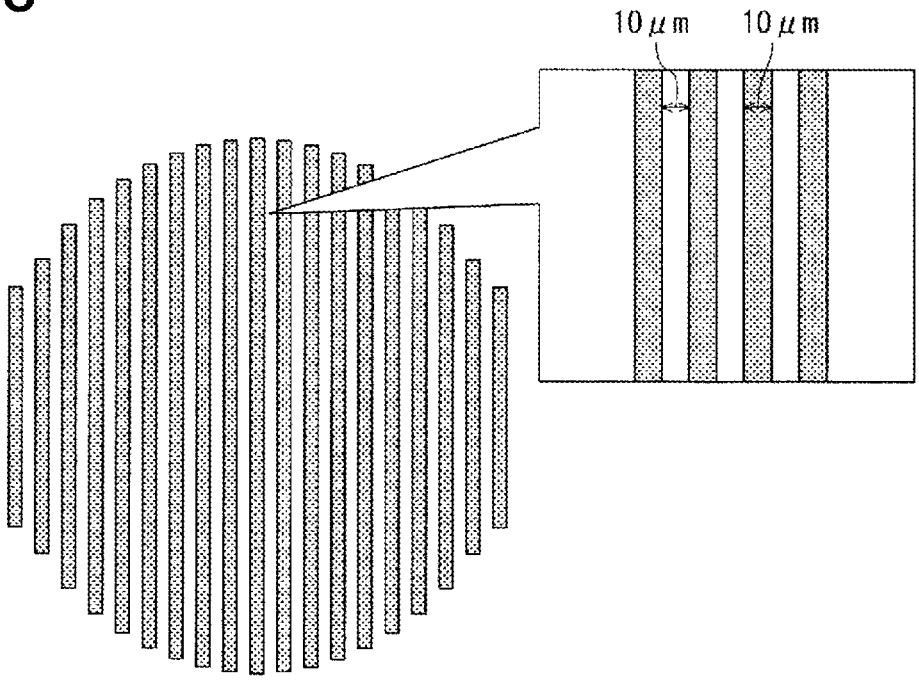
FIG. 33 is a schematic diagram illustrating an example of a line pattern, according to the second embodiment.

FIG. 33 is a schematic diagram illustrating a line pattern in which lines 4 are unidirectionally arranged. As shown in FIG. 33, black lines are arranged at regular intervals to produce a spherical printed portion 3. In this example, the line width D of the black line was set to 10 μm, and the spacing S was set to 10 μm.

Figure 34:
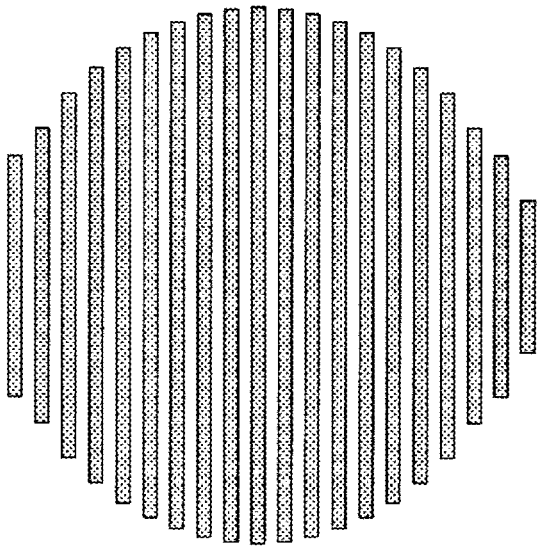
FIG. 34 is a schematic diagram illustrating an example of a line pattern, according to the second embodiment.

FIG. 34 is a schematic diagram obtained by aligning the line patterns shown in FIGS. 32 and 33 and respectively arranging them on front and back surfaces (A surface and B surface) of the printing substrate 2 for superposition. As shown above, these patterns are individually visually recognized as having a different color of green or black. However, when these patterns on the front and the back are combined, the design pattern as produced will exhibit different colors depending on visual observation angles.

Figure 35:
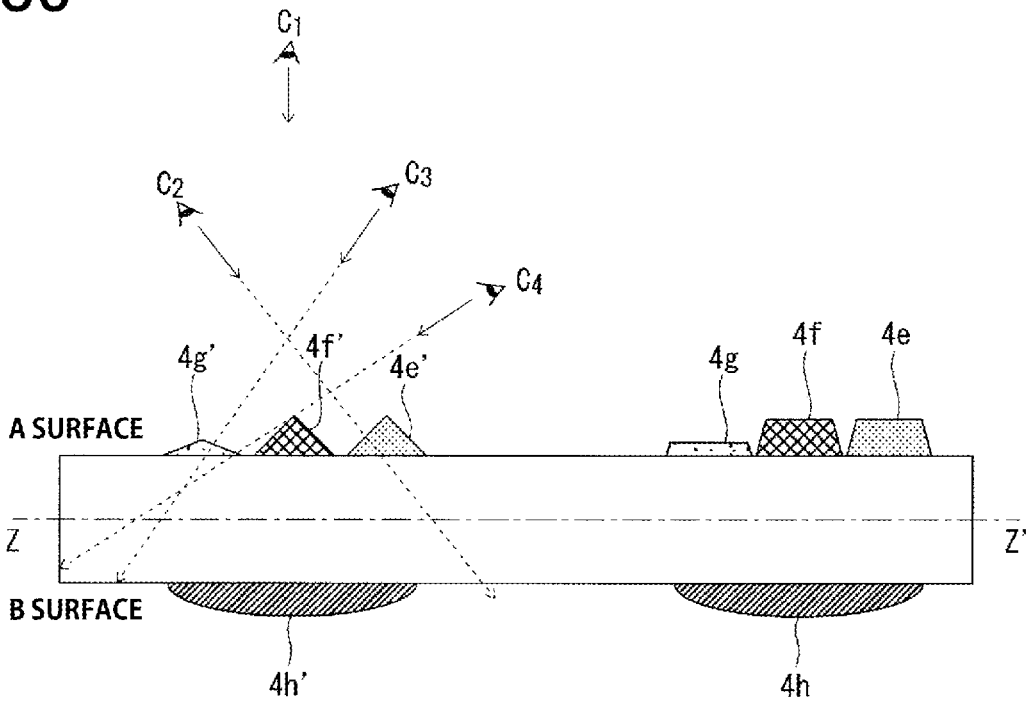
FIG. 35 is a cross-sectional view illustrating a configuration of a printed portion, according to the second embodiment.

FIG. 35 is a schematic diagram illustrating the phenomenon of exhibiting different colors depending on observation angles in the example shown in FIG. 34. As shown in FIG. 35, when visually observed from the viewpoint C1, only black is recognized due to light transmitted through the B surface (back surface). In contrast, when visually observed from the viewpoint C2, the color of the line 4*e*' can be recognized through a spacing that is an interval between the lines on the B surface.

Moreover, when visually observed from the viewpoint C3, the color of the line 4*g*' can be recognized through a spacing that is an interval between the lines on the B surface. Furthermore, when visually observed from the viewpoint C4, the color of the line 4*f*' can be recognized through a spacing that is an interval between the lines on the B surface. Therefore, these portions, which are constituted of lines 4, can be visually observed through the spacings even when a thin printing substrate 2 is used and there is less difference in the optical path of transmitted light. Thus, the printing substrate 2 of the printed matter 1 can be made thin.

FIGS. 32 to 34 each show an example the printed portion 3 having a circular contour to simplify the line pattern. However, in the present embodiment, the printed portion 3 should not be limited to have a circular contour. The contour of the printed portion 3 may be polygonal, such as rectangular, or may be in other shapes. For example, in the case of a concentric line pattern, polygonal lines 4 may be arranged with the centers being aligned. The spacings S do not need to be even, but they can be.

In the present embodiment, the colors exhibited (visually recognized) in the printed portion 3 are determined by the combination of colored lines 4. The combination of colored lines 4 has already been described in the first embodiment. Therefore, details are omitted herein.

The printed portion 3 is preferably formed by intaglio printing because the ink that constitutes each line 4 is printed standing up from the printing substrate 2. In this way, the printed portion 3 is formed by combining a plurality of lines 4 which are regularly arranged in a specific line pattern, with the lines 4 standing up. Thus, an uneven structure is formed by the plurality of lines 4. Therefore, by changing the visual observation angle relative to the surface of the printed matter 1 (printing substrate 2), light is permitted to interfere and color is permitted to appear varying. Alternatively, by using parallax due to printing on the front and back surfaces (A surface and B surface) of the printing substrate 2 and by changing the visual observation angle, color is permitted to appear varying. This is particularly effective when lines 4 of two or more colors are combined.

As in the first embodiment, each standing line 4 may have a height of 1.5 μm or more, and preferably 2 μm or more, from the printing substrate 2. The unevenness of the lines 4 exerts a subtle stereoscopic effect. Regular arrangement of such lines 4 allows light to effectively interfere and, depending on the observation angle, more prominently changes colors.

For example, as shown in FIG. 35, when colored lines 4 with the same width are arranged such that a combination of three lines, i.e. a magenta colored line 4*e*, a magenta colored line 4*f*, and a yellow colored line 4*g*, is iterated in a predetermined direction on the front surface (A surface), and a black line 4*h* is iterated on the back surface (B surface), the printed portion 3 appears to be black when observed from right above, but appears to be pink when observed from the magenta side, and to be yellow when observed from the yellow side. Thus, the visually recognized color comes to vary depending on the viewing direction by designing the array of the lines 4 of two or more colors in terms of direction.

As shown in FIG. 19, an ink layer having a convex structure has a height (layer thickness) H which is preferably 5 μm or less as in the first embodiment. The height H of one ink layer having a convex structure has already been described in the first embodiment. Therefore, details are omitted herein.

Figure 22:
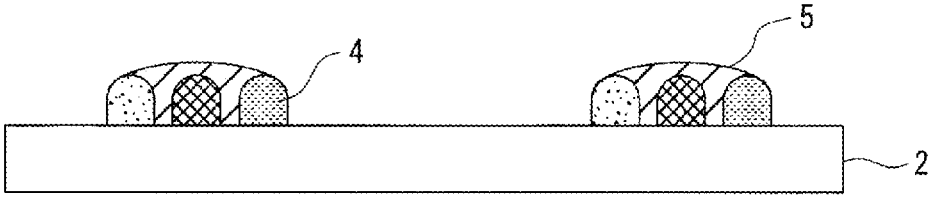
FIG. 22 is a cross-sectional view illustrating an example of a line pattern obtained by lamination, according to the second embodiment.
Figure 23:
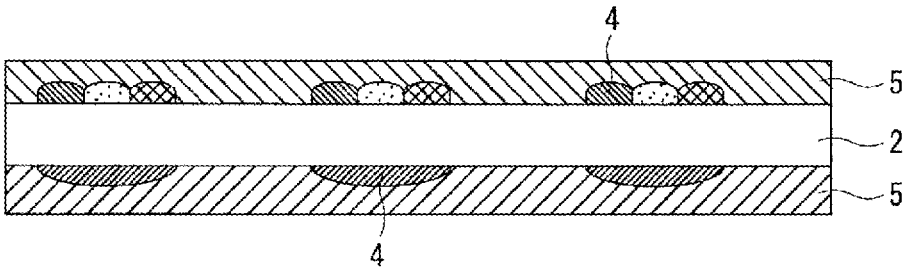
FIG. 23 is a cross-sectional view illustrating an example of a line pattern including a surface protective layer, according to the second embodiment.

In the present embodiment, as shown in FIGS. 22 and 23, a surface protective layer 5 made of a transparent resin, such as an acrylic resin, may be formed over the printed portion 3 having unevenness to protect the printed portion 3 as in the first embodiment. The surface protective layer 5 may have a lens function. Moreover, fine particles may be dispersed in the surface protective layer 5. As the fine particles, spherical or amorphous particles may be used.

Figure 24:
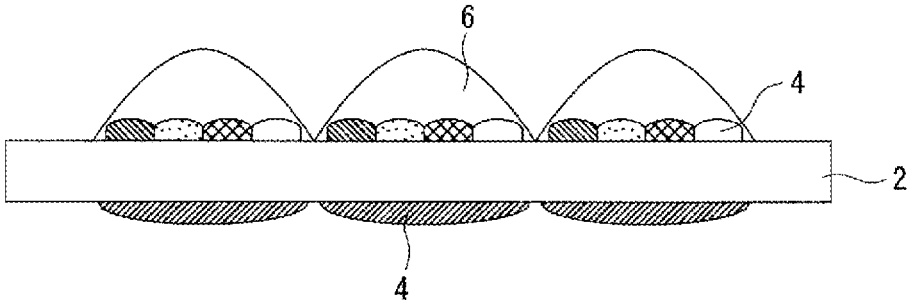
FIG. 24 is a cross-sectional view illustrating an example of a line pattern and a lens configuration, according to the second embodiment.

As shown in FIG. 24, lenses 6 may be formed on the printed portion 3. For example, the lenses 6 may extend in the depth direction as viewed in the figure. Examples of the lenses that can be used in the present embodiment include a cylindrical lens array having a surface configuration including flat surfaces and convex surfaces, a prism lens array, a microlens array, and a lens array having a configuration obtained by combining these arrays. In addition to these lens arrays, the lens array that can be used may be one that is molded such that at least one or more kinds of substantially identical or asymmetric lenses are arranged in stripes or dots, or irregularly. The lenses may be in the shape of polygonal pyramid, cone, polygonal trapezoid, circle trapezoid, polygonal column, cylindrical column, cuboid, sphere, hemisphere, or ellipsoid.

Figure 25:
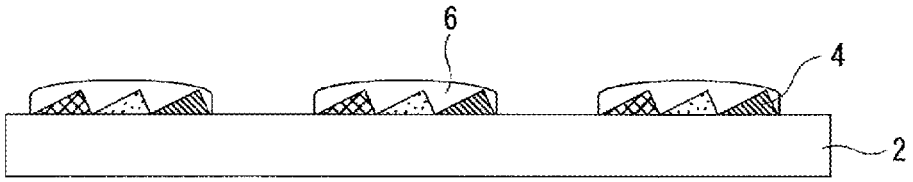
FIG. 25 is a cross-sectional view illustrating an example of a line pattern and a lens configuration, according to the second embodiment.
Figure 26:
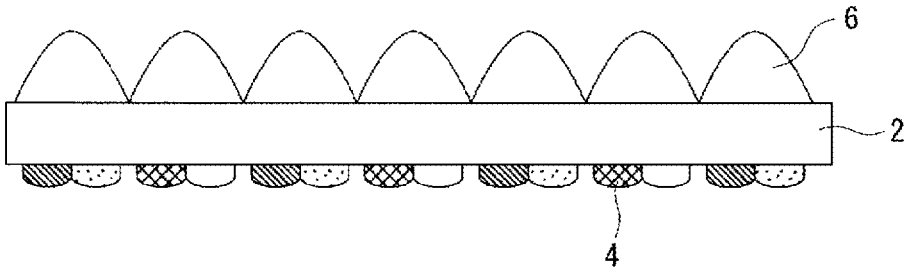
FIG. 26 is a cross-sectional view illustrating an example of a line pattern and a lens configuration, according to the second embodiment.
Figure 27:
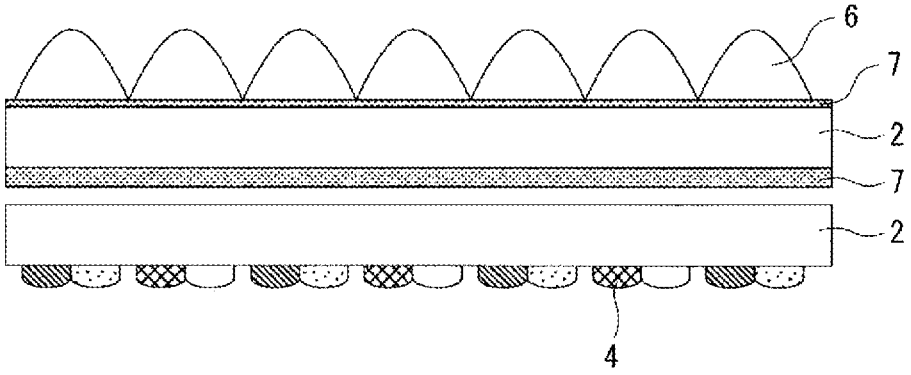
FIG. 27 is a cross-sectional view illustrating an example of a line pattern and a lens configuration, according to the second embodiment.
Figure 28:
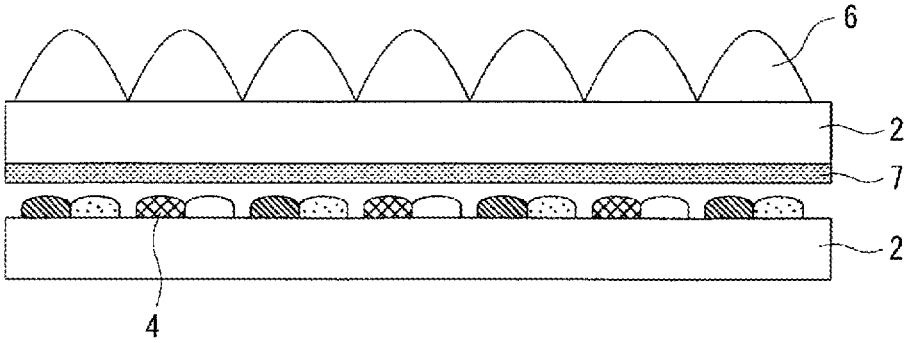
FIG. 28 is a cross-sectional view illustrating an example of a line pattern and a lens configuration, according to the second embodiment.

As shown in FIG. 25, lenses 6 may be unevenly formed on the printed portion 3. Although the lenses 6 may be formed on the printed portion 3 as shown in FIG. 25, a printed portion 3 may be formed, as shown in FIG. 26, on the back surfaces of lenses 6 formed in advance. For example, these lenses 6 may be integrally formed via an adhesive material. As the integral forming method, the back surfaces (B surfaces) of two printing substrates 2 may be bonded together through an adhesive material 7, as shown in FIG. 27, or the back surface of a substrate 2 having lenses 6 on the front surface may be bonded, as shown in FIG. 28, to the printed portion 3 of another substrate 2 via an adhesive material 7.

Examples of the adhesive material 7 used for integral formation include vinyl acetate, acrylic-based adhesive materials, urethane-based adhesive materials, rubber-based adhesive materials, and silicone-based adhesive materials. Because these are used at high temperatures, the storage modulus G' at 100° C. is preferably $1.0\times10^4$ Pa or more. If the storage modulus is lower than this, the adhesive material 7 and the printing substrate 2 may be displaced from each other while being used.

The adhesive material 7 or the lenses 6 may be mixed with transparent particles, such as organic particles or inorganic particles, having different refractive indices. The adhesive material 7 may be in the form of a double-sided tape or a monolayer. The adhesive material 7 may be processed into a sheet-like shape in advance, or may be directly applied to a desired portion of the printing substrate 2. The surface that faces the adhesive material 7 may be corona-treated in advance.

Examples of the method of applying an adhesive/tackifier layer (adhesive material 7) include extrusion coating, methods using various coating devices, such as a comma coater, printing methods, methods using a dispenser or spray, and manual coating using a brush or the like.

The material of the fine particles may be inorganic fine particles or organic fine particles. Specific examples of fine particles include acrylic particles, styrene particles, styrene acrylic particles, and crosslinked products thereof; melamine-formalin condensate particles; polyurethane-based particles, polyester-based particles, silicone-based particles, fluorine-based particles, and copolymers thereof; clay compound particles, such as smectite, kaolinite, and talc; inorganic oxide particles, such as silica, titanium oxide, alumina, silica alumina, zirconia, zinc oxide, barium oxide, and strontium oxide; and inorganic fine particles, such as calcium carbonate, barium carbonate, magnesium carbonate, barium chloride, barium sulfate, barium nitrate, barium hydroxide, aluminum hydroxide, strontium carbonate, strontium chloride, strontium sulfate, strontium nitrate, strontium hydroxide, and glass particles. These kinds of particles may be used singly or as a mixture of two or more.

The fine particles may be replaced by fine voids containing air. In this case, these voids may be produced by allowing a foaming agent to foam, which is contained in a material serving as a main material. Further, inorganic fine particles or organic fine particles may be surface-treated by coating, vapor deposition, or the like, and these kinds of particles may be used singly or as a mixture of two or more.

Moreover, the upper cross-sectional profile of each line 4 having a convex structure may include an inclined part serving as an inclined surface. The cross-sectional profiles of the lines 4 having a convex structure can be controlled by adjusting the cross-sectional profiles of the grooves formed in the printing plate for intaglio printing. The inclined surface, when included in the upper cross-sectional profile of each line 4 having a convex structure, can make the variety of color changes richer when the printed portion 3 is observed obliquely relative to the printing substrate 2, and can randomize color changes.

In the present embodiment, all or part of the plurality of lines 4 constituting the printed portion 3 does not necessarily need to have a convex structure. However, the convex structure, if provided, may exert prominent color changes depending on visual observation angles. The lines 4 not having a convex structure may be formed by relief printing.

According to the present embodiment, high-definition printed matter (fine printed matter) 1 can be obtained by combining fine lines 4 and producing printing, such as a design pattern, that can be visually recognized as a series of colors. The printing substrate 2 is not limited to a sheet-shaped substrate, but may be a three-dimensional substrate, such as toys, and the printed portion 3 may be formed on a surface of the three-dimensional substrate.

As described above, the printed portion 3 provided to the printed matter 1 of the present embodiment can be produced with a preset specific line pattern so that light interference is permitted to occur. Therefore, for example, anticounterfeit effect or designability can be imparted to the printed matter 1 of the present embodiment, using a simple hologram.

The printed portion 3 constituted of the lines 4 described above, that is, the printed portion 3 having fine rises (convex structure) of inks, can be formed by, for example, intaglio printing based on gravure offset printing as in the first embodiment.

(Overall Structure of Printing Device)

The printing device that can be used for gravure offset printing in the present embodiment is the same as the printing device 10 described in the first embodiment. Moreover, the materials or the like used in the printing device 10 are also the same as those mentioned in the first embodiment. Therefore, details are omitted herein.

(Light-Scattering Particles to be Mixed)

In the present embodiment, inks may be mixed with light-scattering particles. The light-scattering particles that can be mixed with inks are the same as those mentioned in the first embodiment. Therefore, details are omitted herein.

(Printing Method)

The printing method of the present embodiment is the same as one described in the first embodiment. Therefore, details are omitted herein.

In the present embodiment, in the case where line patterns are superimposed using a plurality of printing plates 13, or intaglio plates, an alignment mark may be printed. The alignment mark may be in a circular, cross, or radial shape which may be one that can clearly indicate the longitudinal and lateral positions at the time of image recognition using a camera. The alignment mark is located outside the region of the printed matter. It is preferable that two or more alignment marks are diagonally located relative to the printed matter. The alignment accuracy is preferably within ±10 μm, and more preferably within ±5 μm.

If the alignment accuracy is out of the above range, the lines may overlap, and a color different from the set color may be developed. In addition, light interference is unlikely to occur, and it may be difficult to produce a parallax image. Thus, by adjusting alignment and then performing printing, a preset specific line pattern can be printed using a plurality of printing plates 13, or intaglio plates.

(Formation of Printing Plate)

The method of forming a printing plate in the present embodiment is the same as the method of forming the printing plate 13 described in the first embodiment. Therefore, details are omitted herein.

Other Embodiments

The present invention should not be construed as being limited to the modes shown in the above embodiments, but may include various modifications, applications, and equivalents which are encompassed by the idea of the present invention as defined by the claims. Therefore, the present invention should not be narrowly construed, but may be applied to any other techniques belonging to the scope of the idea of the present invention.

For example, in each embodiment described above, a pattern is transferred using a flat printing plate 13. However, this should not impose a limitation, but a pattern may be transferred using a cylindrical printing plate.

In an embodiment described above that uses a cutting blade, concavities are cut using a cutting blade having a single nose part. However, this should not impose a limitation, but concavities may be cut using an odd-form cutting blade having a plurality of nose parts.

In each embodiment described above, the ink 16 is transferred to the printing substrate 2 through the blanket 12. However, this should not impose a limitation, but the ink 16 may be directly transferred from the printing plate 13 to the printing substrate 2.

In each embodiment described above, a printing pattern of the ink 16 is formed on the printing substrate 2. However, this should not impose a limitation, but the printing substrate 2 may be removed after a printing pattern has been formed thereon, so that the configuration of the printing pattern is maintained only by itself.

In each embodiment described above, electrical conductivity may be imparted to the ink 16. This electrical conductivity can be utilized in various applications, such as authentication based on energization of the printed portion 3, usage as an electric circuit member, or the like. The ink 16, if it is made of a chromic material, can be used for various applications, such as authentication that is based on reversible reaction due to electrical power and physicochemical action, and usage as an electrical circuit member.

Advantageous Effects of the Embodiments (1) The printed matter 1 of the present embodiment has a printed portion 3 on a surface of a printing substrate 2. The printed portion 3 is formed of an ink and visually recognized as a continuous color pattern. Further, the printed portion 3 is constituted of a combination of a plurality of lines 4 each being formed from an ink and having a line width D of 100 μm or less. Of the plurality of lines 4, two adjacent lines 4 have a spacing S there between which is 50 times or less the line width D of the line 4 that is the narrower one of the two lines 4 defining the spacing S.

With this configuration, printed matter with a continuous color pattern, such as a high-definition fine design pattern, can be obtained using a print structure different from ones based on conventional art. With this configuration, visually effective images can be produced only by printing. Further, use of fine lines can significantly reduce the thickness of substrates when an integral method is used.

Therefore, the printed matter 1 of the present embodiment can be used in place of holograms using diffracted light, holograms using polarized light, or the like, which have been used for valuables, such as bank notes, passports, securities, cards, stamps, CDs, or commodity tags, requiring protection against counterfeiting, falsification, and replication.

(2) The printed portion 3 of the present embodiment may be constituted of a combination of colored lines 4 of two or more colors.

With this configuration, higher-definition fine printed matter can be obtained.

(3) The plurality of lines 4 constituting the printed portion 3 of the present embodiment may be arranged in a region for forming the printed portion 3 so as to have a preset specific line pattern.

With this configuration as well, high-definition fine printed matter can be obtained.

(4) The line pattern constituting the printed portion 3 of the present embodiment may be at least one of a pattern in which the lines 4 are arranged unidirectionally, a pattern in which the lines 4 are arranged concentrically, a pattern in which the lines 4 are arranged in a lattice shape, and a pattern in which the lines 4 are arranged radially.

With this configuration as well, high-definition fine printed matter can be obtained.

(5) Color gradation of the printed portion 3 of the present embodiment may be adjusted by controlling the line width D of the plurality of lines 4 arranged in a unit area.

With this configuration, color gradation can be easily controlled in high-definition fine printed matter.

(6) At least part of the plurality of lines 4 of the present embodiment may have a convex structure having a height H of 1.5 μm or more relative to the surface of the printing substrate 2.

With this configuration, high-definition fine printed matter can be obtained more reliably.

(7) The printed portion 3 of the present embodiment may have a plurality of lines 4 having a convex structure, and some of the plurality of lines 4 having a convex structure may have a height H that is 1.5 times or more the height H of the rest of the lines 4.

With this configuration as well, high-definition fine printed matter can be obtained more reliably.

(8) The printed portion 3 of the present embodiment may have a plurality of lines 4 having a convex structure, and at least part of the plurality of lines 4 having a convex structure may have a multilayer structure in which a plurality of inks is layered.

With this configuration as well, high-definition fine printed matter can be obtained more reliably.

(9) The printed portion 3 of the present embodiment may have a plurality of lines 4 having a convex structure, and at least part of the plurality of lines 4 having a convex structure may have an inclined part forming an inclined surface, in an upper part of a cross section that is orthogonal to the direction in which the lines 4 extend.

With this configuration as well, high-definition fine printed matter can be obtained.

(10) The line pattern of the present embodiment may be formed using at least one or more intaglio plates, and may allow light interference or parallax to occur by being printed, with the alignment being adjusted.

With this configuration as well, high-definition fine printed matter can be obtained.

(11) The line pattern of the present embodiment may be a pattern that is permitted to change color depending on visual observation angles, by forming or lamination-printing a preset specific line pattern from intaglio plates, with the alignment being adjusted, onto one surface or each of front and back surfaces of the printing substrate 2 for location on the same single surface.

With this configuration, printing, such as a design pattern, can be produced in which fine lines are combined for visual recognition as a series of colors, by performing printing using a plurality of plates, with the alignment being adjusted. Furthermore, by only performing printing, a parallax image whose color changes depending on visual observation angles can be produced. In addition, high-definition printed matter can be obtained, even when printed through an integral method involving changing, by use of thin substrates in combination with lenses, whereas the substrates have conventionally been required to be thicker.

(12) The printed matter 1 of the present embodiment may include lenses 6 unidirectionally extending over the plurality of lines 4 and each having a polygonal cross section that is orthogonal to the direction in which the lines extend, or lenses 6 having a configuration that is any combination of curved surfaces.

With this configuration, visibility of the high-definition fine printed matter can be increased.

(13) In the printed matter 1 of the present embodiment, lenses 6 may be unevenly arranged on the plurality of lines 4.

With this configuration as well, visibility of high-definition fine printed matter can be increased.

(14) In the printed matter 1 of the present embodiment, the plurality of lines 4 may have a surface covered with a surface protective layer 5 made of a transparent resin.

With this configuration, high-definition fine printed matter can be protected.

(15) The printing plate 13 of the present embodiment is used for intaglio printing and has a plurality of linear grooves (concavities 13*a*) each having a width of 100 μm or less on part of the printing surface of the base material. In the printing plate 13, the plurality of grooves has regions, each being a spacing between two adjacent grooves and set to 50 times or less the groove width that is the narrower one of the two adjacent grooves defining the spacing.

With this configuration, high-definition fine printed matter can be printed.

(16) In the printing plate 13 of the present embodiment, at least part of the plurality of grooves (concavities 13*a*) may have a width or depth different from that of the rest of the grooves.

With this configuration as well, high-definition fine printed matter can be printed.

(17) In the method of producing the printed matter 1 of the present embodiment, using a plurality of printing plates 13 in which a plurality of linear grooves (concavities 13*a*) each having a width of 100 μm or less are formed on part of a surface of the base material as printing plates for intaglio printing, intaglio printing is sequentially carried out to transfer the ink 16 onto the surface of the printing substrate 2 to thereby form the printed portion 3, and the grooves formed on one of the plurality of printing plates 13 each have a width or depth different from that of the grooves formed on the remaining printing plates 13.

With this configuration, higher-definition fine printed matter can be printed.

REFERENCE SIGNS LIST

1 . . . Printed matter; 2 . . . Printing substrate; 3 . . . Printed portion; 4 . . . Line; 4*a* to 4*l* . . . Line; 4*e*' to 4*h*' . . . Line; 5 . . . Surface protective layer; 6 . . . Lens; 7 . . . Adhesive material; 9 . . . Printing plate base material; 9*a* . . . Copper plating layer; 9*b* . . . Release layer; 9*c* . . . Copper Ballard layer; 9*d* . . . Cylindrical body; 10 . . . Printing device; 12 . . . Blanket; 13 . . . Printing plate; 13*a* . . . Concavity; 14 . . . Blanket body; 16 . . . Ink; 17 . . . Printing plate-fixing platen; 18 . . . Substrate-fixing platen; 19 . . . Doctor blade; 41 . . . Line; 42 . . . Line; D . . . Line width; S Spacing; H . . . Height of one layer of line; C1 to C4 . . . Visual line; D . . . Line width; S . . . Spacing; H . . . Height' X . . . Cross-sectional part; X' . . . Cross-sectional part; Y Cross-sectional part; Y' . . . Cross-sectional part; Z . . . Cross-sectional part; Z' . . . Cross-sectional part.

What is claimed is:

1. A printed matter, comprising:

a printed portion directly on a flat surface of a printing substrate;

wherein the printed portion consisting of a combination of a plurality of lines each consisting of one or more inks and having a line width of 100 μm or less; and two adjacent lines of the plurality of lines have a spacing there between that is 50 times or less the line width of a narrower one of the two adjacent lines defining the spacing, wherein each line of the plurality of lines has a convex structure, and a part of the plurality of lines having a convex cross-section and wherein each line of said plurality of lines has a thickness in a direction perpendicular to the flat surface of 5 microns or less.

2. The printed matter of claim 1, wherein the printed portion is constituted of a combination of colored lines of two or more colors.

3. The printed matter of claim 1, wherein the plurality of lines constituting the printed portion are arranged with a preset specific line pattern in a region for forming the printed portion.

4. The printed matter of claim 3, wherein the line pattern is at least one of a pattern in which the lines are arranged unidirectionally, a pattern in which the lines are arranged concentrically, a pattern in which the lines are arranged in a lattice shape, and a pattern in which the lines are arranged radially.

5. The printed matter of claim 4, wherein the line pattern is formed using intaglio plates, and can be formed having light interference or parallax by being printed with an alignment of the intaglio plates being adjusted.

6. The printed matter of claim 1, wherein the printed portion exhibits color gradation that is created by changing the line width of the plurality of lines arranged in a unit area.

7. The printed matter of claim 1, wherein the convex structure has a height of 1.5 μm or more relative to the surface of the printing substrate.

8. The printed matter of claim 1, wherein the printed matter includes lenses unidirectionally extending over the plurality of lines and each having a polygonal cross section that is orthogonal to a direction in which the lines extend, or lenses having a configuration that is any of curved surfaces.

9. The printed matter of claim 1, wherein lenses are unevenly arranged over the plurality of lines.

10. The printed matter of claim 1, wherein the plurality of lines has surfaces covered with a transparent resin.

11. The printed matter of claim 1, wherein the convex cross-section has a semicircular shape, a triangular shape or a trapezoidal shape.

12. The printed matter of claim 1, wherein the convex cross section has a semicircular shape.

13. The printed matter of claim 1, wherein the convex cross section has a triangular shape.

14. The printed matter of claim 1, wherein the convex cross section has a trapezoidal shape.

15. The printed matter of claim 1, wherein a thickest line of said plurality of lines has a thickness in a direction perpendicular to the flat surface 1.5 times or more greater than that of a thinnest line of said plurality of lines.

16. The printed matter of claim 1, wherein the printed portion comprises a two-layer laminate on the flat surface, each of the two layers of the two-layer laminate consists of an ink of the one or more inks.

17. The printed matter of claim 1, wherein the printed portion comprises a three-layer laminate on the flat surface, each of the three layers of the three-layer laminate consists of an ink of the one or more inks.

* * * * *